US012422178B2

(12) United States Patent
Larson et al.

(10) Patent No.: US 12,422,178 B2
(45) Date of Patent: Sep. 23, 2025

(54) HYBRID ICE MAKER

(71) Applicant: ILLINOIS TOOL WORKS INC., Glenview, IL (US)

(72) Inventors: Eric K. Larson, Cumberland, RI (US); Juan J. Barrena, Johnston, RI (US); William D. Chatelle, Cranston, RI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 18/220,139

(22) Filed: Jul. 10, 2023

(65) Prior Publication Data

US 2023/0349616 A1 Nov. 2, 2023

Related U.S. Application Data

(62) Division of application No. 17/153,632, filed on Jan. 20, 2021, now Pat. No. 11,725,861.

(60) Provisional application No. 63/084,976, filed on Sep. 29, 2020, provisional application No. 62/963,784, filed on Jan. 21, 2020.

(51) Int. Cl.
*F25C 1/24* (2018.01)
*F25C 5/08* (2006.01)

(52) U.S. Cl.
CPC ..... *F25C 1/24* (2013.01); *F25C 5/08* (2013.01); *F25C 2305/0221* (2021.08); *F25C 2500/02* (2013.01); *F25C 2500/08* (2013.01)

(58) Field of Classification Search
CPC ..... F25C 2500/08; F25C 2500/02; F25C 2305/0221; F25C 5/08; F25C 2500/06; F25C 1/246; F25C 1/24; F25C 2700/12
See application file for complete search history.

(56) References Cited

U.S. PATENT DOCUMENTS

| | | | | |
|---|---|---|---|---|
| 1,764,787 | A | 6/1930 | Hatch | |
| 9,146,050 | B2 | 9/2015 | Jeong | |
| 10,126,037 | B2 | 11/2018 | Barrena et al. | |
| 2007/0068189 | A1* | 3/2007 | Villani | F25C 1/045 62/340 |
| 2009/0151795 | A1* | 6/2009 | Hsu | F25C 1/25 137/386 |

(Continued)

FOREIGN PATENT DOCUMENTS

| | | |
|---|---|---|
| CN | 102538329 A | 7/2012 |
| KR | 10-2014-0075288 | 6/2014 |

OTHER PUBLICATIONS

U.S. Patent Office, English language version of the International Search Report, Form PCT/ISA/210 for International Application PCT/US2021/014356, Jun. 17, 2021 (6 pages).

(Continued)

*Primary Examiner* — Cassey D Bauer

(74) *Attorney, Agent, or Firm* — Pauley Erickson & Swanson

(57) ABSTRACT

An ice making device provides an ice tray and a frame to hold the ice tray. The frame has a proximal end with a motor and a distal end with a circular opening. An insert positioned in the circular opening with a projection provides a vibrating motion to dislodge ice cubes from the ice tray. An ice tray includes an integrated heating circuit for sensing capacitance and releasing frozen ice cubes. An ice tray also includes a raised flange to prevent water from splashing out of the ice tray.

11 Claims, 20 Drawing Sheets

(56) References Cited

U.S. PATENT DOCUMENTS

| | | | | |
|---|---|---|---|---|
| 2012/0186288 | A1 | 7/2012 | Hapke | |
| 2012/0247130 | A1* | 10/2012 | Ito | F25C 1/04 62/126 |
| 2019/0011167 | A1* | 1/2019 | Larson | F25C 5/08 |

OTHER PUBLICATIONS

U.S. Patent Office, English language version of the Written Opinion of the ISA, Form PCT/ISA/237 for International Application PCT/US2021/014356, Jun. 17, 2021 (10 pages).

* cited by examiner

HYBRID ICE MAKER

CROSS REFERENCE TO RELATED APPLICATION(S)

This application is a Divisional application of U.S. patent application Ser. No. 17/153,632, filed on 20 Jan. 2021 which claims the benefit of U.S. provisional application, Ser. No. 63/084,976, filed on 29 Sep. 2020, and of U.S. provisional application, Ser. No. 62/963,784, filed on 21 Jan. 2020. The co-pending parent and related applications are hereby incorporated by reference herein in their entirety and are made a part hereof, including but not limited to those portions which specifically appear hereinafter.

BACKGROUND OF THE INVENTION

Field of the Invention

This invention relates generally to an icemaking machine and, more particularly, to an icemaking machine providing improved energy efficiency with ice dislodge features and water splash control prior to freezing.

Description of Prior Art

Icemaking machines according to the current state of the art are generally incorporated into household refrigerators. Such icemakers are normally located in a freezer compartment of the refrigerator. Such icemakers often involve an ice cube tray positioned in the freezer area to receive water from a valve integrated with the refrigerator. The water fills the ice tray to a predetermined volume. Once ice cubes have formed in the tray, the ice is normally expelled from the tray to an ice holding bin somewhere beneath the tray. The ice is usually expelled from the tray by twisting and inverting the ice tray or by slightly heating the ice tray with a comb that pushes the cubes out of the tray. The amount of ice in the ice tray may be determined with a bail arm which periodically lowers into the ice tray to check the ice level. The bail arm becomes blocked when there is a high level of ice in the bin. This blockage is detected and stops ice production.

To create an ice cube tray, the trays are normally fabricated, for example, from a highly conductive material such as aluminum and a central calorie rod ("cal-rod") heater may be attached to the tray to heat the tray. Such systems are effective in releasing ice but often use substantial electrical power in excess of 100 watts. In systems where the ice tray is twisted and inverted for ice removal, the ice tray may be constructed of a robust injection molded plastic material or the like that can resist substantial cycling and distortion.

Some icemaking machines are now integrated into doors of refrigerators, which poses an additional challenge that the filled ice cube trays must be able to withstand the disturbance caused by refrigerator doors opening and closing, without spilling water from a newly filled ice tray. To avoid spilling water, a tray with a greater depth can be used, but using a tray of greater depth increases issues with heater circuit performance. Therefore, a need exists for improved ice trays for ice making machines to accommodate a variety of placements of icemakers inside refrigerators while still being able to control splashing of water without sacrificing depth or other sizing of the ice cube trays, as well as allowing ice cube displacement to occur with heated or non-heated tray options.

SUMMARY OF THE INVENTION

The invention generally relates to provide an improved icemaker that is incorporated with refrigeration systems with an improved ice tray. The subject icemaker may include an extremely light-weight ice tray that can be fabricated by thermoforming, a process in which a planar, thin sheet of thermoplastic material is heated to a pliable state and then formed by drawing a vacuum between the plastic sheet and the mold as well as applying air pressure above the plastic sheet. The subject icemaker may include a heater circuit used with a 2-piece tray design to allow for a heater circuit to be formed while also controlling water splashing as a refrigerator door is opened and closed and sensing radiofrequencies within the ice tray. Other embodiments of the invention may eliminate the requirement for a heater circuit due to vibration to an ice tray that dislodges ice cubes allowing ice to be harvested without the use of heat.

The general object of the invention can be attained, at least in part, through an icemaker that includes an ice tray and a frame to hold the ice tray. The frame includes a proximal end with a motor and a distal end with a circular opening. An insert is positioned in the circular opening of a side of the frame. The insert includes a slot to hold an edge of the ice tray. The insert can rotate inside the circular opening of the frame. The insert can also rotate the ice tray when the slot holds the edge of the ice tray. The insert includes a projection positioned relative to a circumference of the insert.

Additionally, the circular opening includes a plurality of protrusions on a circumference of the circular opening. The projection of the insert can engage with the plurality of protrusions of the circular opening upon rotation of the insert. In some embodiments of the invention, the protrusions are arranged in a lower portion of the opening. In some embodiments of the invention, the protrusions are arranged within a single quadrant of the opening.

The general object of the invention can also be attained, at least in part, through an icemaker with an ice tray having a plurality of pockets for molding water into ice cubes. The icemaker includes a first electrode positioned adjacent to at least one pocket of the plurality of pockets and a second electrode positioned adjacent to at least one pocket of the plurality of pockets. The first and second electrodes detect a capacitance of water in the ice tray. The icemaker also includes a controller that communicates with the first and second electrodes in a first state to allow filling of the plurality of pockets of the ice tray with water. The controller also communicates with the first and second electrodes in a second state, after completion of the first state, to detect a phase change of the water to ice in the plurality of pockets.

A heater is also included in the icemaker to activate and deactivate based on the phase change of the water to ice. An ejector ejects ice from the plurality of pockets after water in the pockets freezes into ice cubes. The ejector can activate and deactivate the heater. The heater includes a screen-printed circuit integrated into a surface of the tray. The screen-printed circuit also includes a secondary circuit that can sense contents and a phase of the contents in the ice cube tray. The secondary circuit includes a plurality of sensing elements to control a water level in the plurality of pockets. The sensing elements include capacitive signals. The sensing elements also include radiofrequency signals.

In embodiments of the invention, the ice tray includes a raised flange that fits over a perimeter of the tray. The raised flange of the ice cube tray includes a wall that extends around a perimeter of the raised flange. In some embodiments of the invention, the ice cube tray is integrated in an icemaker in a refrigerator. In some embodiments of the invention, the ice cube tray is integrated in an icemaker in a door of a refrigerator. The ice tray is also preferably thermoformed from a planar sheet of thermoplastic.

The invention also includes a method for utilizing an icemaker by inserting an ice tray within a frame of the icemaker, freezing water deposited in the ice tray, engaging at least one edge of the ice tray with a rotatable insert positioned within the frame, and rotating the insert upon a formation of ice within the ice tray. The method may also include rotating the ice tray by rotating of the insert. The method further includes vibrating the ice tray upon rotation of the insert to dislodge a plurality of ice cubes from the tray. The vibrating results from engagement between a projection on a circumference of the rotatable insert butting against at least one protrusion on the frame.

The invention further includes a method of fabricating an ice tray for an icemaker. The method includes heating a substantially planar sheet of thermoplastic to a pliable forming temperature and forming the planar sheet into an ice tray by drawing the thermoplastic into a plurality of recesses in a mold. Each recess of the plurality of recesses forms a pocket (for creating an ice cube). The ice tray is attached to a motor driven shaft of an icemaker. The method also includes positioning the ice tray in a first position for filling the pockets with water and positioning the ice tray in a second position for ejecting frozen water from the pockets. The first position is about 180 degrees from the second position.

The ice tray may be fabricated by printing a plurality of electrical conductors on the planar sheet of thermoplastic prior to heating. The plurality of electrical conductors includes a heating pattern. The heating pattern heats to dislodge ice cubes from the ice tray. The method also includes sensing when water in the ice tray is frozen with a circuit integrated in the ice tray. The circuit includes at least one of capacitive signals and radiofrequency signals.

Embodiments of the invention also include adding a perimeter barrier around a top of the ice cube tray to prevent spilling of water upon movement of the icemaker.

Other objects and advantages will be apparent to those skilled in the art from the following detailed description taken in conjunction with the appended claims and drawings.

DETAILED DESCRIPTION OF THE INVENTION

The present invention provides an icemaker with various improvements, specifically an icemaker with an ice dislodge feature and water splash control using a thermoformed ice tray with radiofrequency sensing. An icemaker as in the claimed invention includes an ice tray having multiple pockets for receiving water and molding the water into frozen ice cubes of various shapes and sizes defined by the pockets. The icemaker may be an icemaker integrated with a refrigerator or may be freestanding. As is common in the art, the icemaker integrated with a refrigerator may be located at various positions within the refrigerator. In some embodiments of the invention, the icemaker is located in a door of the refrigerator. The ice tray may be positioned in the icemaker above a collection bin that collects formed ice cubes once frozen. The collection bin stores a defined amount of ice cubes for use while the icemaker continuous to make additional ice cubes in the ice cube tray.

Figure 1:
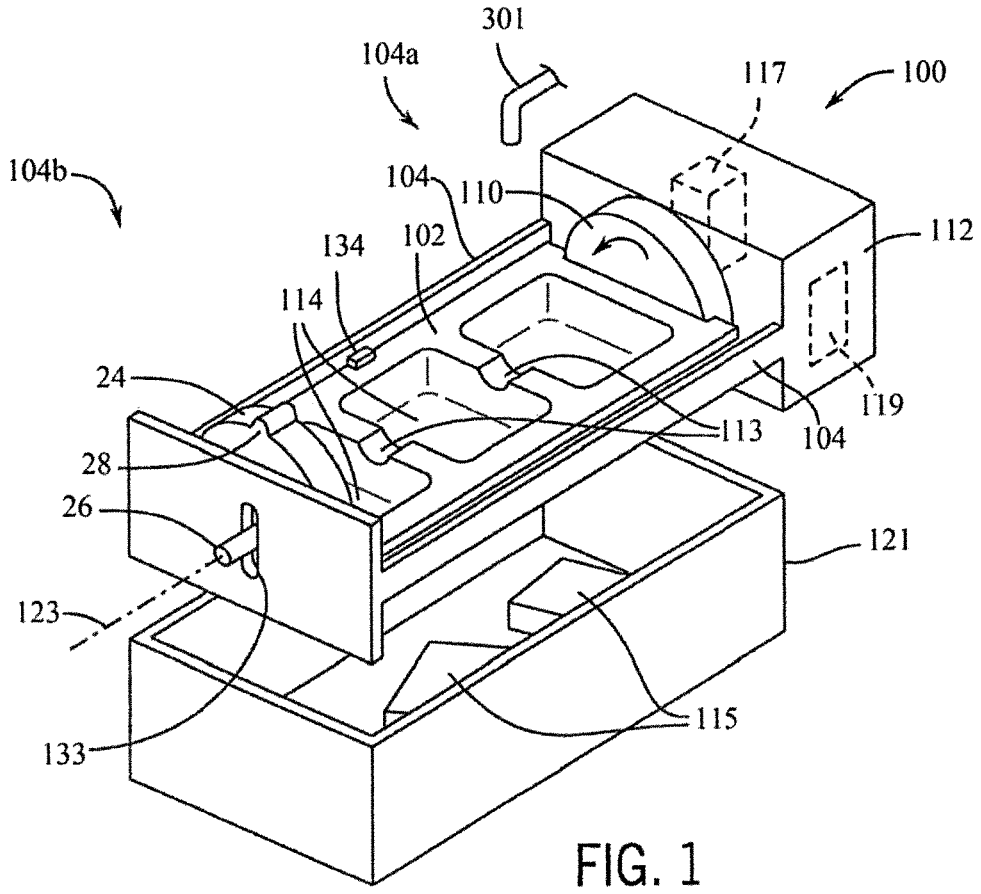
FIG. 1 is a perspective view of an icemaker according to one embodiment of the invention.

In one embodiment of the invention as shown in FIG. 1, an icemaker 100 includes an ice tray 102 having multiple pockets 114 for receiving water and molding the water into frozen ice cubes 115 of arbitrary shape defined by the pockets 114. The ice tray 102 is positioned adjacent to a drive housing 112. The drive housing 112 exposes a rotatable drive 110 connected to a proximal end 104*a* on a frame 104 of the ice tray 102. A distal end 104*b* of the rotatable drive 110 communicates within the drive housing 112 with an electric motor 117 for rotating the ice tray 102 between a first position (as shown in FIG. 1) allowing the ice tray 102 to be filled with water and a second position (not shown)

rotated approximately 180 degrees about a rotation axis 123 of the rotatable drive 110 so that the ice tray 102 is inverted to discharge ice cubes into a lower collection bin 121. The ice tray 102 as shown includes three pockets 114 communicating by inter-pocket channels 113 allowing the equalization of a water level within each pocket 114 if desired. The motor 117 is controlled by a controller 119, for example, including a microcontroller and associated circuitry as will be discussed below. The controller 119 may also communicate with a valve (not shown) controlling water through a nozzle 301 for use in filling the ice tray 102 when the ice tray 102 is in the upright position as depicted.

Figure 2:
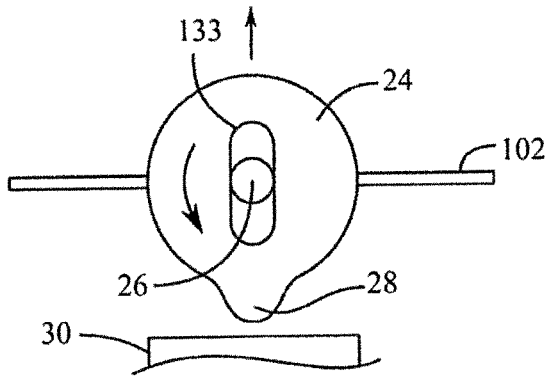
FIG. 2 is a partial side of view an icemaker according to the embodiment of FIG. 1.

FIG. 2 shows the distal end 104*b* of the ice tray 102 connected to a cam disk 24 being a generally circular disk radially symmetric about an axle 26 but having a high radius portion 28 extending outward from the disk 24. The high radius portion 28 is positioned at an upper periphery of the cam disk 24 when the ice tray 102 is in the upright position as shown in FIG. 1. When the ice tray 102 is in an inverted or ejecting position, as shown in FIG. 2, the high radius portion 28 engages with a stop element 30 on the frame 104.

Figure 3:
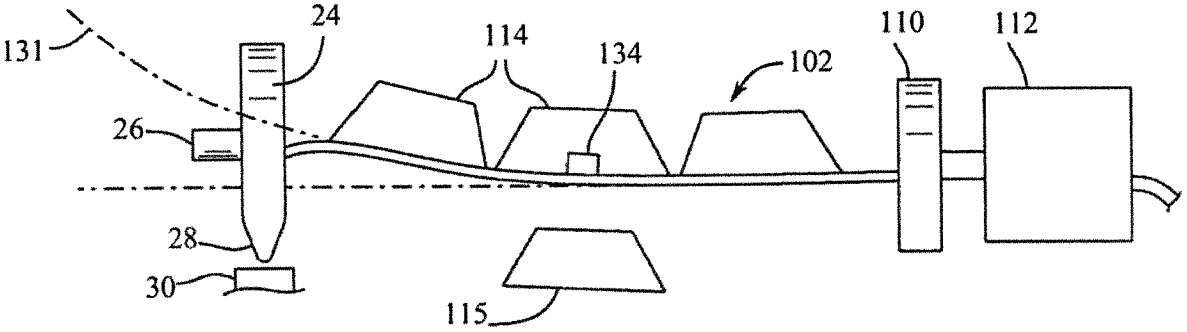
FIG. 3 is a cross-sectional view of an icemaker according to the embodiment of FIG. 1.

As shown in FIG. 3, this engagement between the high radius portion 28 and the stop element 30 lifts the axle 26 within a slotted journal 133 which causes a bowing of the ice tray 102 along curvature line 131. The curvature line 131 is generally upwardly concave to promote ejection of ice cubes 115 from the pockets 114. This bowing is facilitated by a stationary catch 134 positioned on the frame 104 extending inward toward the rotation axis 123. The stationary catch 134 can hold down a middle of the ice tray 102 when the ice tray 102 is in the inverted position.

In embodiments of this invention, the ice tray, including the pockets, may be fabricated by thermoforming the ice tray from a thin polymer material, for example, a thin polymer material having a thickness of less than 0.40 inches, preferably, 20 mils (0.020 inches) which provides substantial flexibility in the pockets of the ice tray. The flexibility of the thin polymer material permits improved ejection of the ice cubes with very little mechanical distortion, prolonging the life of the material.

Figure 4:
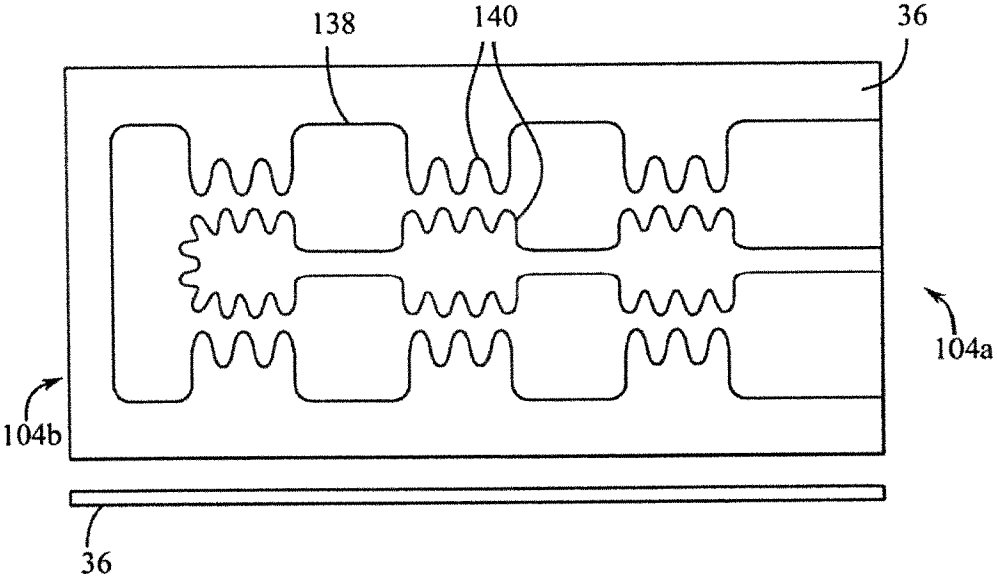
FIG. 4 is a top view of an icemaker according to the embodiment of FIG. 1.
Figure 5:
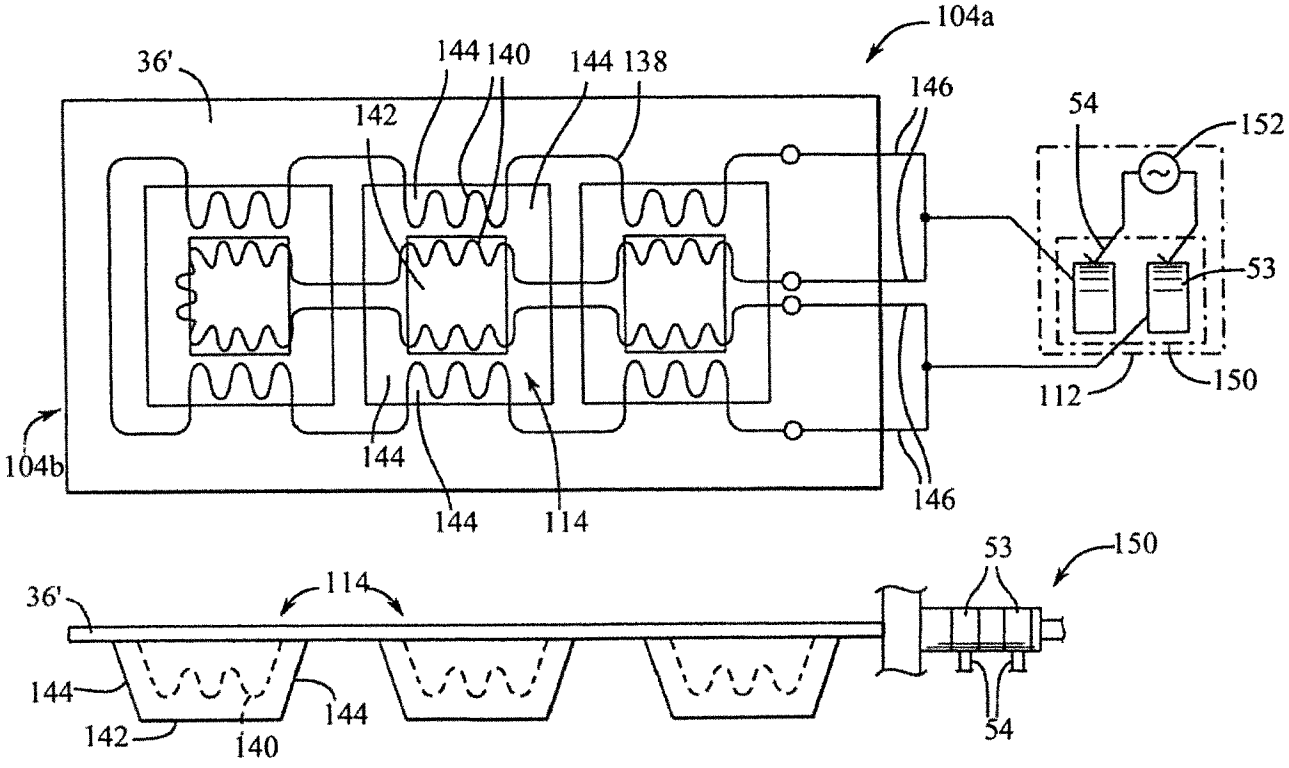
FIG. 5 is a partial top and cross-sectional view of an icemaker according to an embodiment of the invention.

To further aid in ejection of the ice cubes, embodiments of the invention may also include heater elements integrated with the ice tray. FIGS. 4 and 5 show a conductor pattern 138 to provide serpentine heater elements 140. The heater elements 140 are positioned on a rectangular bottom surface 142 and also on each of four upstanding sidewalls 144 that extend upwardly from the bottom surface 142 of each pocket 114. Other embodiments may include a varying number of side walls. The patterns for the heater elements 140 may be pre-distorted to have the proper shape after thermoforming. The heater elements 140 may be pre-distorted according to the shape and size of the pockets and/or of the ice tray as a whole. As shown, the heater elements 140 are interconnected in an electrical series and in parallel electrical circuits as desired to control the desired currents and heating of each heater element 140. It is to be understood the number, arrangement and type of electrical circuits may vary according to individual characteristics of the ice tray and icemaker.

FIG. 5 also shows secondary conductors 146 attached to printed conductor pattern 138. The conductors 146 may desirably be solid metal strips or solid single or multi-strand conductive wire with an outer insulating material as is generally understood in the art. The conductors 146 connect the printed conductor pattern 138 to a slip ring assembly 150 allowing slips rings of the slip ring assembly 150 to communicate with a voltage source 152 within the housing 112. The slip ring assembly 150 may be any slip ring assembly known in the art, including a circular cylindrical conductor ring 53 and brushes 54, such as the assemblies described in U.S. Pat. No. 10,126,037, entitled "Ice-Maker Motor with Integrated Encoder and Header," hereby incorporated by reference. Generally, the voltage source 152 will apply a current to the heater elements 140 so that the power consumption of the heaters is less than 10 watts, although other voltage levels may also be applicable.

Figure 6:
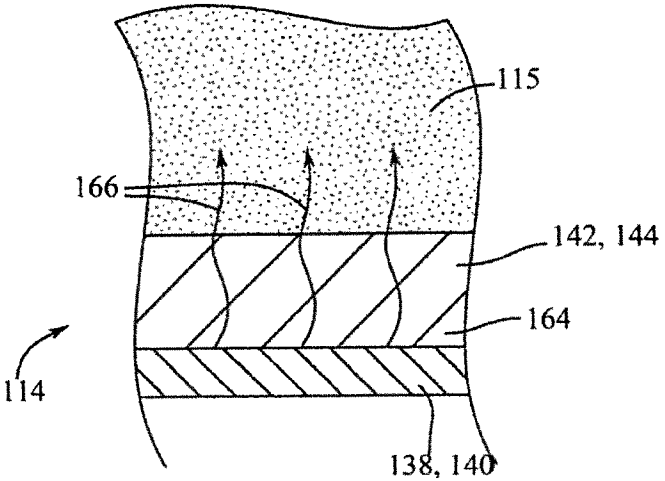
FIG. 6 is a partial cross-sectional view of an ice tray according to an embodiment of the invention.

As shown in FIG. 6, using an extremely thin thermoformed material 164 to make the bottom surface 142 and sidewalls 144 of the pockets 114 for the ice tray 102, according to embodiments of this invention, provides a reduced thermal mass so that the material 164 can absorb heat from the heater elements 140. This absorption allows most of the heat energy from the heater elements 140 to pass, as indicated by arrows 166, into ice cubes 115 so that surface heating can release the ice cubes 115 from the pockets 114. This heating effect is amplified by the fact that the heater elements 140 are on an outer surface of the pockets 114, which are adjacent to the ice cubes 115, separated only by a thin electrical insulating layer of preferably less than 0.10 inches.

Figure 7:
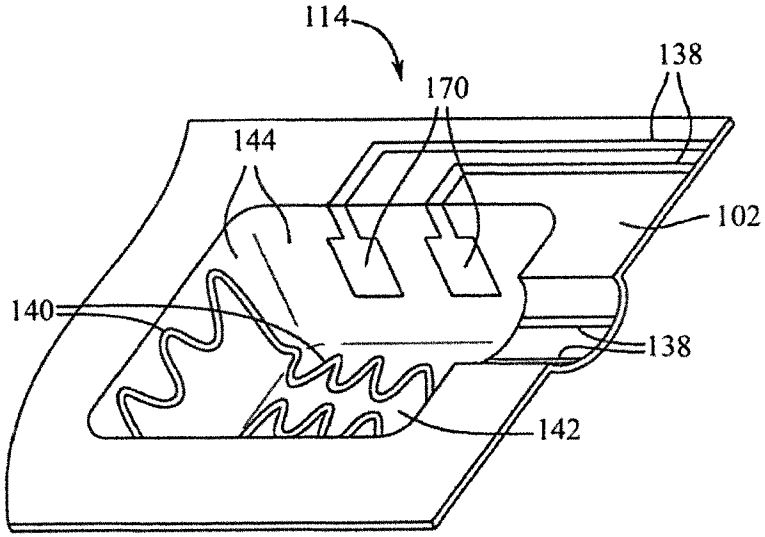
FIG. 7 is a partial perspective view of an ice tray according to an embodiment of the invention.

As shown in FIG. 7, in some embodiments of the invention, one or more of the heater elements 140 may be replaced by capacitive sensing electrodes 170. The electrodes 170 provide two electrodes adjacent to a volume of the pockets 114 and within the pockets 114. The electrodes 170 are electrically isolated except through electrostatic coupling through a dielectric from any material within the volume of the pockets 114. As such, the capacitance between the sensing electrodes 170 varies according to the dielectric or bulk dielectric of the material in each pocket 114. The sensing electrodes 170 are provided by conductive patterns 138 (of material similar to or identical with the conductive patterns used for the heater elements 140) with conductors 146 (not shown) that may also pass through slip rings 150 to communicate with any circuitry within the housing 112.

Figure 8:
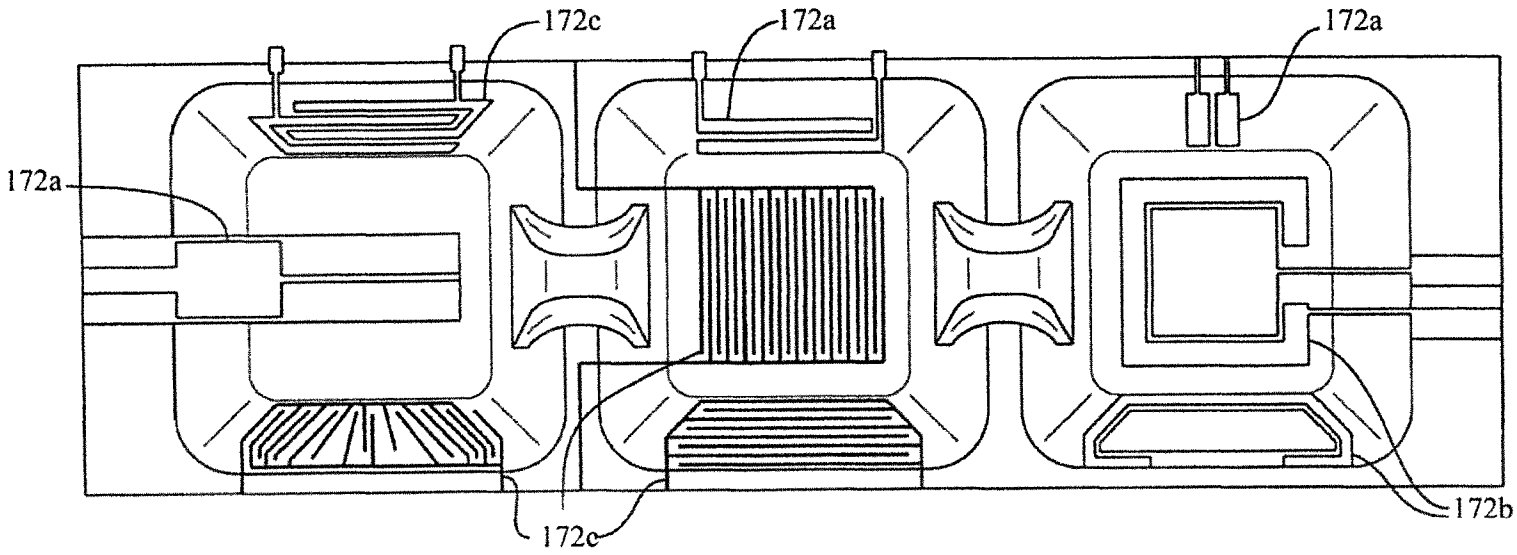
FIG. 8 is a partial top view of an ice tray according to an embodiment of the invention.

FIG. 8 shows a variety of forms the sensing electrodes can provide. Such forms include, but are not limited to, form 172*a* providing adjacent parallel conductive bands, form 172*b* providing a center electrode and a surrounding second electrode, and/or form 172*c* providing interdigitated parallel fingers.

Figure 9:
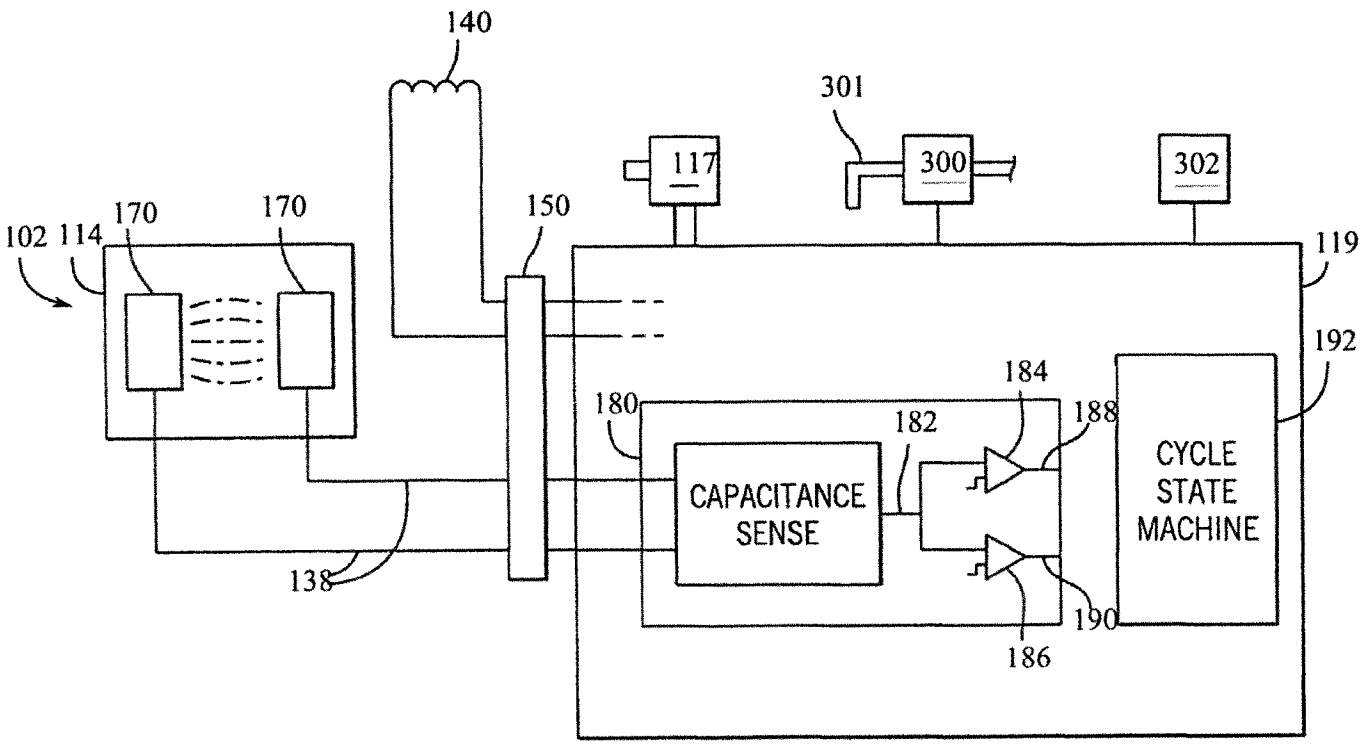
FIG. 9 is a schematic view of an icemaker according to one embodiment of the invention.

As shown in FIG. 9, sensing electrodes 170 may communicate through slip rings 150 with a controller 119. The controller 119 implements a capacitive sensing circuit 180, for example, with dedicated circuitry and/or programming according to techniques well known in the art. For example, the capacitive sensing circuit 180 may incorporate the capacitance of the sensing electrodes 170 into a tuned or resonant circuit whose resonant frequency changes according to the capacitance, and whose frequency may be measured, for example, by pulse counting. Alternatively, the capacitive sensing circuit 180 may operate using a charging system where the capacitance formed by the sensing electrodes 170 are charged and the time constant of that charging is measured through a timing circuit or the like.

The capacitive sensing circuit 180 may provide a capacitance output 182 that may be compared to a water level threshold by a threshold comparator 184 and against a phase change comparator 186. The threshold comparator 184 provides a fill signal 188. The phase change comparator 186 provides a freezing signal 190. The fill signal 188 and the freezing signal 190 may be used by a cycle state sequencer 192 that controls the filling, freezing, and ejection of ice from the ice tray 102. In this regard, the controller 119 also communicates with the motor 117 with a valve 300. The valve 300 communicates with the nozzle 301 for filling the ice tray 102, and with a user interface 302. The user interface 302 may be, for example, a switch that can be activated by the user to turn the icemaker 100 on and off.

Figure 10:
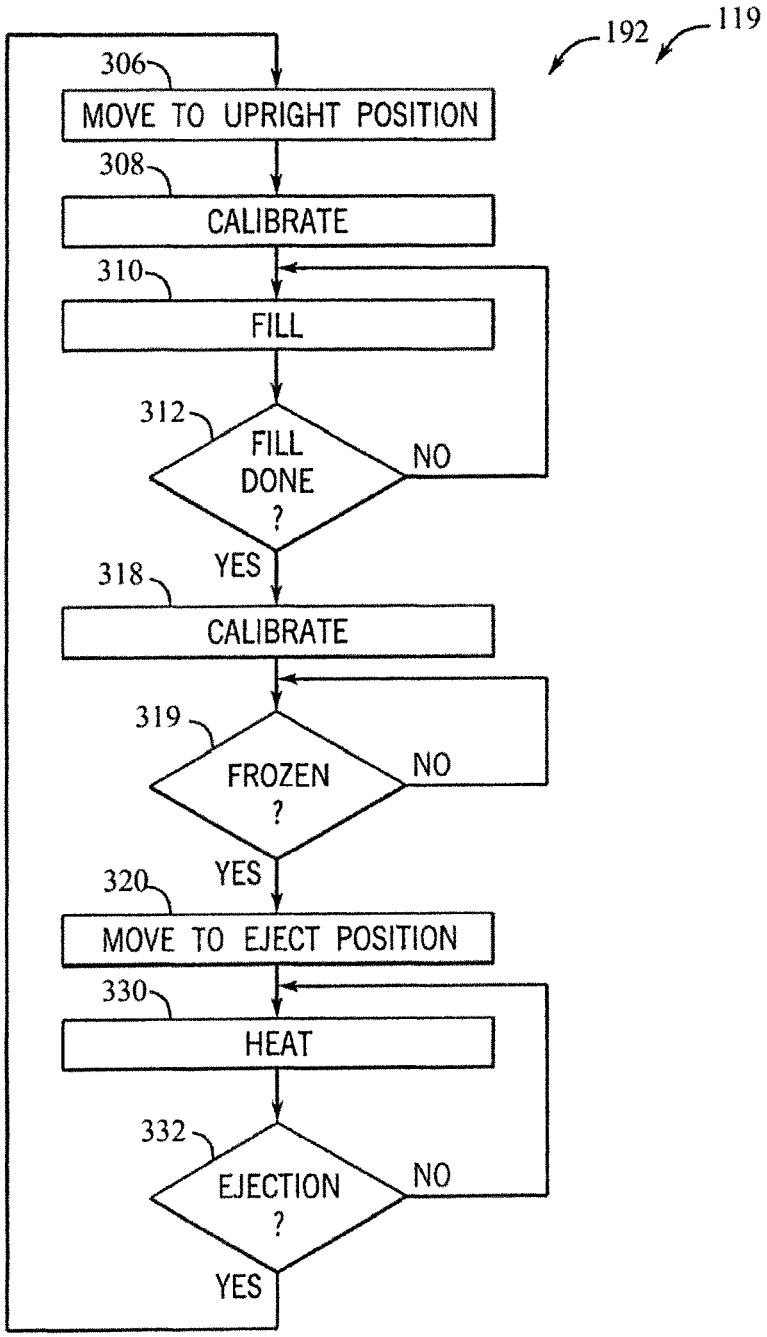
FIG. 10 is a flow-chart according to one embodiment of the invention.

FIG. 10 shows a flow-chart with a first process block 306 where the controller 119 implements the cycle state sequencer 192 which moves ice tray 102 to the first upright position shown in FIG. 1. At this point, as indicated by process block 308, the capacitive sensing circuit 180 may be calibrated to the capacitance of the ice tray 102 and may also adjust the threshold of the comparators 184 and 186 with respect to the calibrated value. At succeeding process block 310, the controller 119 fills the ice tray 102 through the nozzle 301. During this filling process, the capacitance measured by the capacitive sensing electrodes 170 is monitored as indicated by decision block 312 to continue the filling process until the capacitive sensing indicates that the ice mold pockets 114 are fully filled with water.

Figure 23:
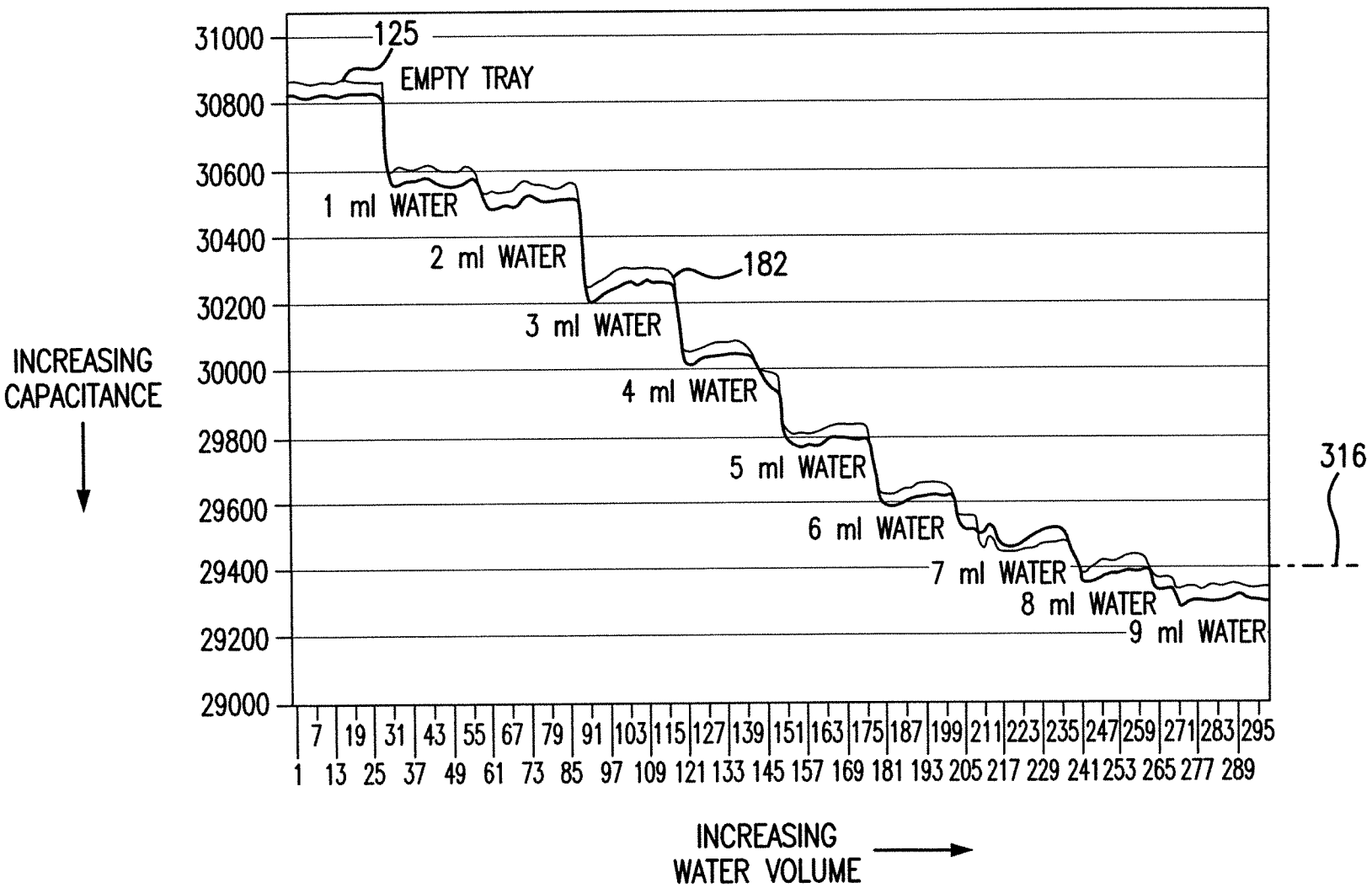
FIG. 23 shows a graph of capacitance versus water volume according to one embodiment of the invention.

As the water level increases in the pockets 114, a volume of air dielectric within each pocket 114 is displaced by a higher dielectric of water, thereby increasing the capacitance output 182 from a calibration level. As shown in FIG. 23, the calibration level is represented by a leveling-off of capacitance (marked as 125). When the capacitance output 182 crosses a predetermined threshold 316, referenced with respect to the calibration step of process block 308 of FIG. 10, the decision block 312 indicates that the fill is complete and the valve 300 is closed. At this point as indicated by process block 318, a new calibration value may be obtained with respect to the capacitance of a pocket filled with water.

Figure 24:
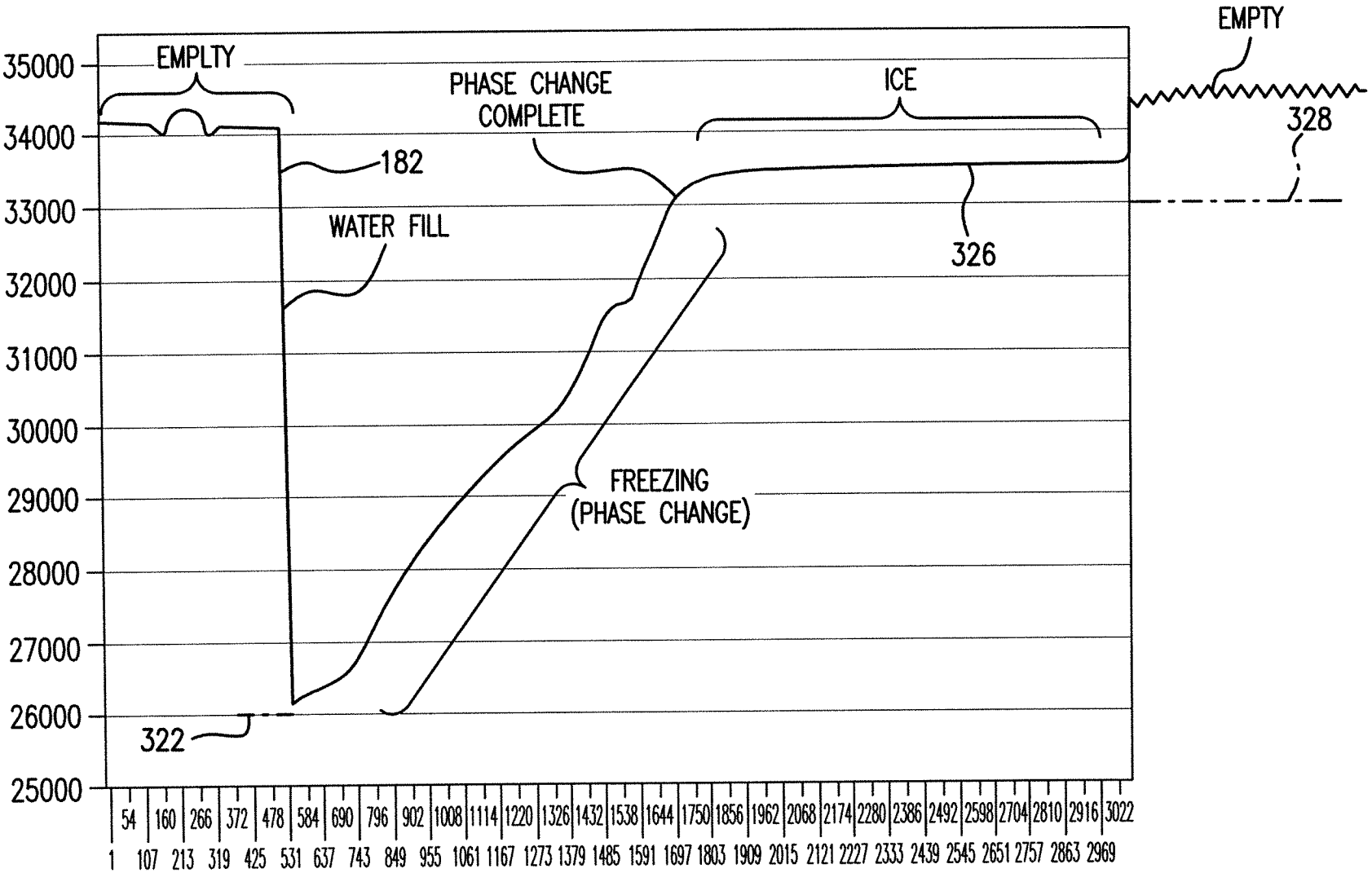
FIG. 24 shows a graph of capacitance versus water volume according to one embodiment of the invention.

As water begins to freeze, the high dielectric water will be replaced with low dielectric ice causing the capacitance to change. This is shown in FIG. 24. The capacitance changes from calibration value 322 to ice capacitance value 326. Per decision block 319 of FIG. 10, this value may be detected either by a leveling off of the capacitance output 182 or against a threshold value 328 per the comparison of comparator 186 of FIG. 9.

As shown in FIG. 10, upon an indication that ice is fully frozen, at decision block 319, the state sequencer 192 may move immediately to eject the ice by inverting the ice tray as indicated by process block 320 to maximize throughput of ice making. This detection of frozen ice immediately eliminates the need for the icemaker to allow for a generous freezing time. Such a generous freezing time may accommodate a range of possible initial water temperature conditions and freezer temperature conditions, but such conditions require additional time for a margin of error in a system based strictly on timing and/or indirect tray temperature.

After inverting the ice tray, the heater elements are activated per process block 330. This activation may be for a predetermined time and may be accompanied by a slight optional flexing of the ice tray (as described above). Alternatively, the capacitive sensing electrodes may be monitored to detect the change in capacitance from pockets full of ice, to pockets empty of ice at the empty level shown in FIG. 24—indicating that sufficient heating has occurred as determined by decision block 332. By actively monitoring ejection of the ice, the amount of time that the heater elements need to be activated can be minimized. Immediately upon ejection of ice cubes, as determined by decision block 332, a new ice cycle may begin per process block 306, thereby maximizing ice throughput.

Figure 11:
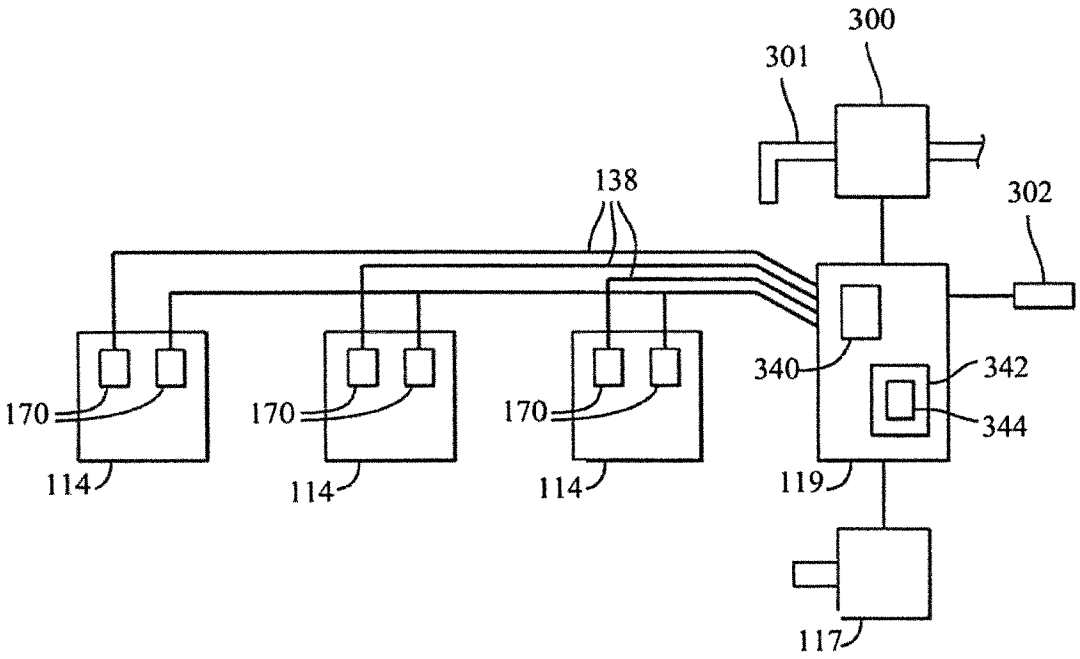
FIG. 11 is a schematic view of an icemaker according to one embodiment of the invention.

In one embodiment of the invention as shown in FIG. 11, each pocket 114 has capacitive sensing electrodes 170 within that pocket 114 and may provide separate conductors of the conductor patterns 138 leading to the controller 119. As a result, the freezing of water in each pocket 114 and ejection of the ice cube from each pocket 114 may be independently determined for each individual pocket 114. Alternatively, a single representative pocket may be chosen to expel ice. Generally, the controller 119 includes a processor 340 and a memory 342 holding a stored program 344 for communication with the motor 117, the valve 300, user interface 302, and the conductors of the conductive patterns 138 for sensing electrodes 170 and heater elements 140.

Figure 12:
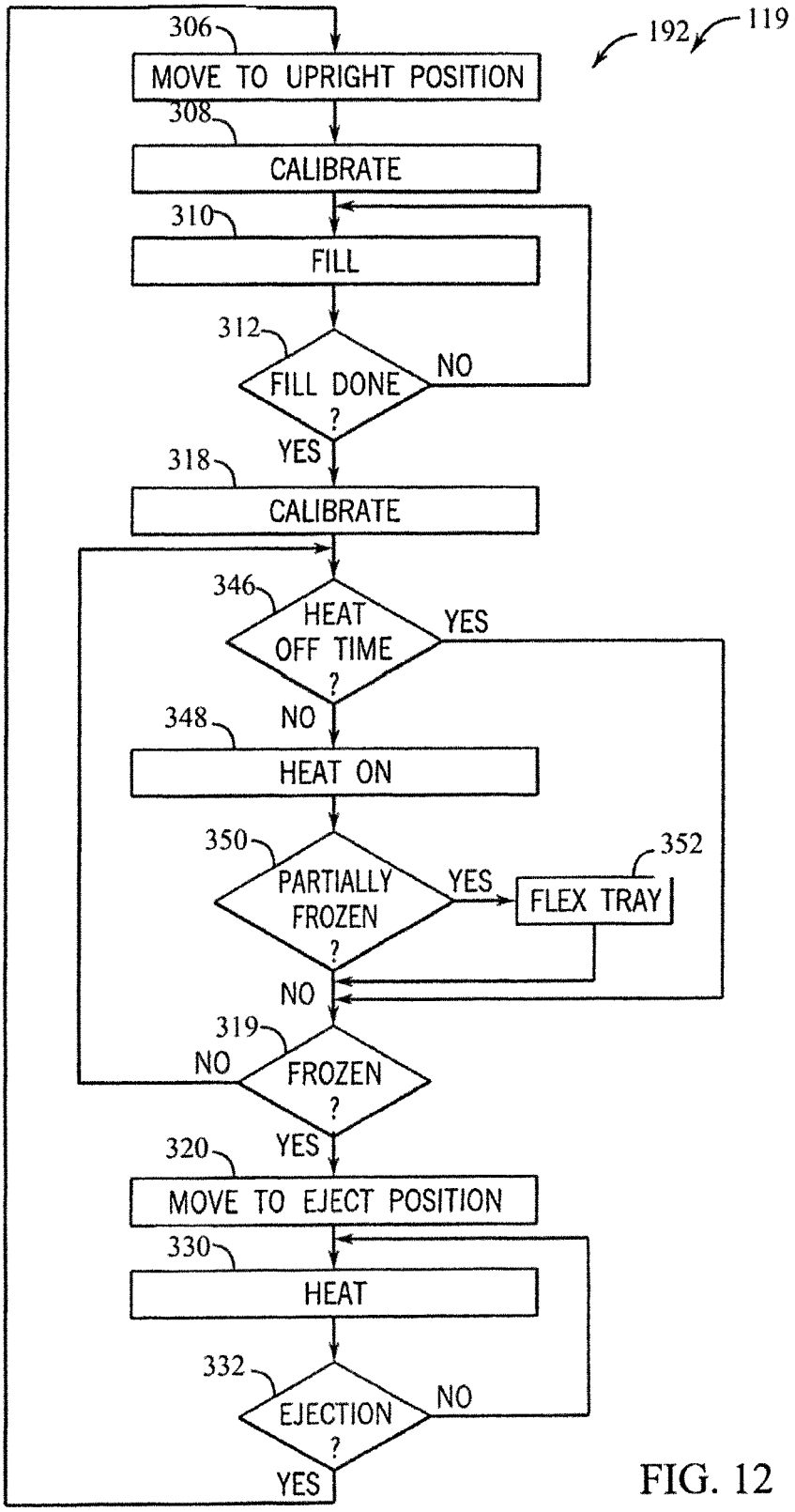
FIG. 12 is a flow-chart according to one embodiment of the invention.

FIG. 12 shows a flow chart according to embodiments of the invention which shows heating of the ice tray during the freezing process to improve ice clarity. A clarity enhancement procedure is shown between the process block 318 and decision block 319. After calibration at process block 318, water is allowed to initially rapidly cool, without heating, during a first portion of a heat-off time intended to accelerate the ice making process. This occurs during temperature ranges that are not critical for improving ice clarity. The controller 119 determines an ending of the heat-off time at decision block 346. This portion of the heat-off time may be tracked by a timer communicating with the controller 119 and may last for a duration empirically determined to allow the water to cool to a sufficiently low temperature, which may be at or preferably slightly above the freezing point.

Instead of elapsed time, ending the heat-off time may be based on temperature. In this approach, the controller 119 may determine whether to end the heat-off time based on a temperature value measured by a temperature sensor such as a thermistor, or the like, mounted to the ice tray 102 in thermal communication with the water of at least one pocket 114. The determination may also be based on sensed capacitive characteristics from electrodes 170 described above.

When a first portion of the heat-off time ends at decision block 346, the ice tray 102 is heated at process block 348 with controller 119 (as shown in FIGS. 1 and 9) further implementing the cycle state sequencer 192 to control the heater elements 140. The heating at process block 348 may be at a reduced heat output or low-level heating compared to that used for the ejection of ice cubes, for example, by use of a lower voltage or by duty cycle modulating electricity applied to the heater elements 140 by a solid-state switching element or the like. This reduced heat output reduces or eliminates freezing of the ice. Slower freezing of the ice may promote an outgassing of water before gas bubbles are trapped under an ice crust.

At decision block 350 of FIG. 12, controller 119 may optionally determine whether water is partially frozen in pockets 114 to the point of having a thin ice crust on top of the water. Similar to determining an ending point for the heat-off time at decision block 346, at decision block 350, controller 119 may evaluate whether the water is partially frozen based on timer value(s) empirically determined to provide a partially frozen condition or based on sensed capacitive characteristics from electrodes 170.

In one embodiment, if a partially frozen state is determined at decision block 350, then controller 119 commands a slight agitation of ice tray 102, such as flexing the tray at process block 352. The agitation or flexing at process block 352 may be a lesser version of rotation (without inverting or spilling water) and/or bowing of the ice tray 102, such as shown in FIG. 3. Although agitation may be minimal, it allows for air bubbles trapped under a thin frozen crust to coalesce into fewer larger bubbles that can escape from the pocket 114 through openings or separations at an interface between the ice crust and heated sidewalls of the pocket 114. The heater elements may be positioned on sidewalls of ice trays to release ice crust from said sidewalls, for example, during the heating procedure at process step 348 of FIG. 12, which may be further facilitated by the slight agitation or flexing of ice tray 102 at process step 352 to provide a mechanical separation force to assist the release.

A second portion of heat-off time begins at decision block 346 as ice clarity improving steps are completed. Alternatively, if the flexing of process block 352 is not used, the heat may be turned off at a predetermined time interval or degree of freezing detected either by temperature or through the capacitive sensing described above. By turning off the heat, full freezing of the ice cubes is accelerated or energy is conserved. Once the cubes have been determined to be fully frozen per decision block 319, the controller moves to additional steps including, but not limited to, reactivation of the heater elements 140 for ejection of the ice cubes.

Figure 13:
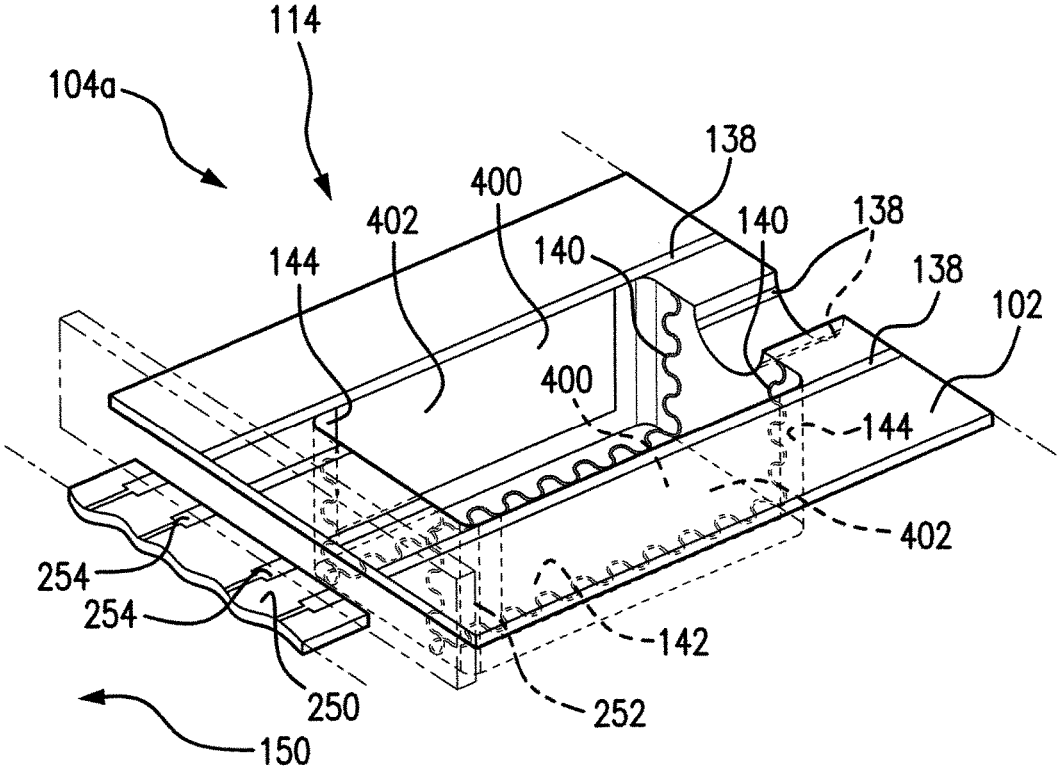
FIG. 13 is a partial perspective view of an ice tray according to one embodiment of the invention.

FIG. 13 shows an embodiment of the invention where radiofrequency signals are used as an alternative to capacitive signals. Here, the ice tray 102 includes radiofrequency antennas 400 on two opposed sidewalls 144 of each pocket 114. The radiofrequency antennas 400 provide two conductive panels 402 opposed across the volume of, and within, the pockets 114. The conductive panels 402 are electrically isolated from each other except through electromagnetic coupling from radiofrequency energy passing through any material within the volume of the pockets 114. Preferably, there is no ohmic contact between the conductive panels 402 nor through water in the ice tray 102. The radiofrequency antennas 400 may be provided by conductive panels 402 substantially covering entire surfaces of opposed sidewalls 144. The conductive panels 402 connect with conductors 138 that can pass through slip rings 150 to communicate with circuitry within the housing 112.

The various conductors 138 communicating with the radiofrequency antennas 400 and heater elements 140 may be printed on the underside of tray 102 and may be connected to a printed circuit board 250 or the like communicating with slip rings 150 using a mechanical clamp 252 that presses exposed conductive surfaces of the underside of the conductors 138 downward against upwardly facing traces 254. The traces 254 are preferably golf or copper-plated, although other relevant materials may be used as well.

Figure 14:
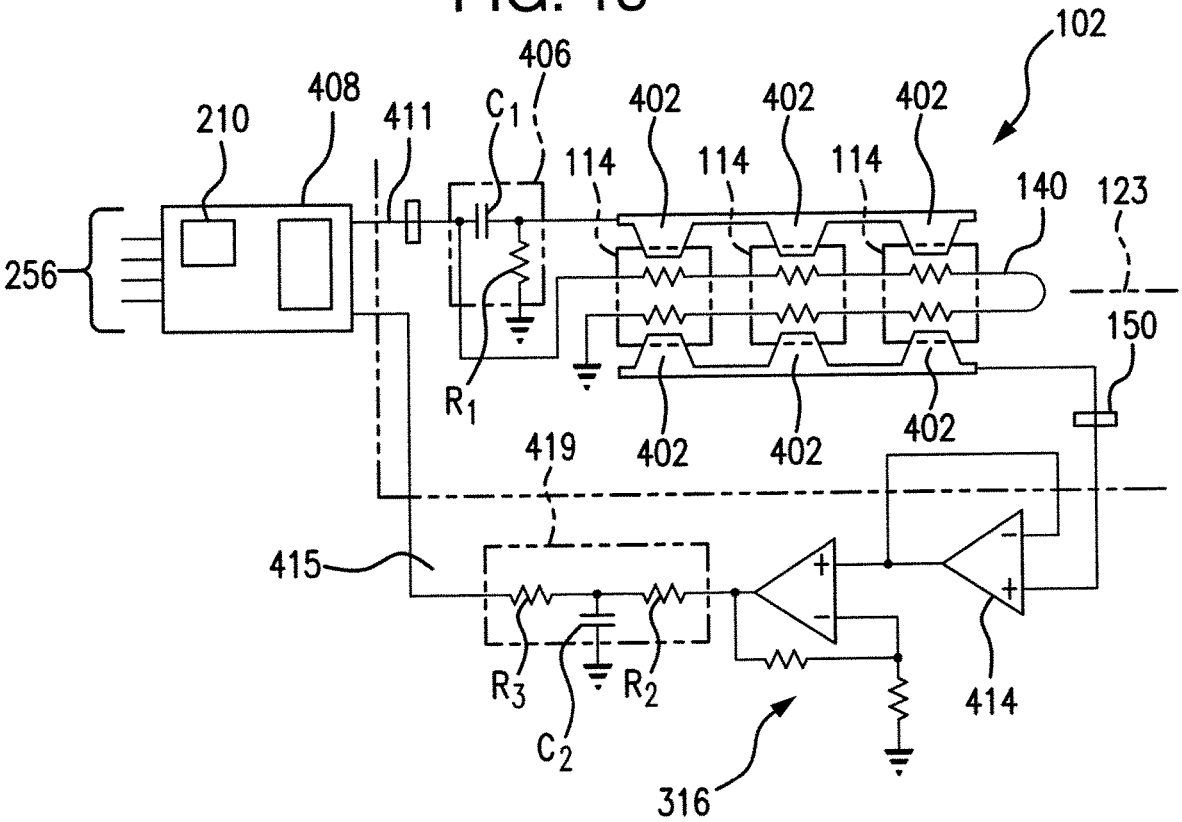
FIG. 14 is a schematic view of an icemaker according to one embodiment of the invention.

FIG. 14 shows conductive panels 402 running along pockets 114. The panels 402 are joined in series in electrical communication with output signals 256. The series connection of panels 402 provides a more robust signal in a given tray 102. When there are multiple rows of pockets 114 along the axis of rotation 123, side panels 402 may be connected in parallel with corresponding side panels of other rows. The panels 402 communicate through a high-pass filter 406 and then through slip rings 150 with the controller 119. The controller 119 outputs a square wave drive voltage 411 at a frequency of 300 kilohertz to three megahertz, desirably 500 kilohertz. The square wave voltage may be provided by dedicated circuitry such as an oscillator or by a microcontroller having a processor 210 executing a stored program to control the icemaking system. In one embodiment, an oscillator may be used to produce a five-volt amplitude square wave.

The high-pass filter 406 prevents the flow of direct current, and isolates panels 402 from heater electrodes 140 with respect to DC current flow. The high pass filter components are sized such that the RC time constant is small compared to half a period of the square wave frequency (e.g., $RC<t/2$, $t=1/\text{frequency}$). This generates an impulse wave on the electrode. In one embodiment, the high-pass filter may provide a series-connected 470-picofarads capacitor (C1) shunted by a 470-ohm resistor (R1) to ground.

Radiofrequency energy from panels 402 may be received by additional panels 402 and connected to an input of a high impedance buffer amplifier 414 (for example, a unity gain operational amplifier having an input impedance in excess of one megaohm). The output of the high impedance buffer amplifier 414 is communicated to a gain amplifier 416 (for example, providing a voltage multiplier of approximately three) which boosts the signal and applies it to a low pass filter 419 which in turn provides a magnitude voltage 415 passing through slip rings 150 to a microcontroller 408. The low pass filter 419, for example, may have a cutoff frequency of around one hertz (although other cutoff frequencies may be present) to provide substantial filtering of the received signal. In one embodiment, the low pass filter 419 provides a series resistor R2 of 100 kiloohms and a shunting capacitor C2 of one microfarad. The circuit according to this embodiment essentially extracts the DC average value of the received signal. A peak-to-peak amplitude or RMS signal may also be useful.

Figure 15:
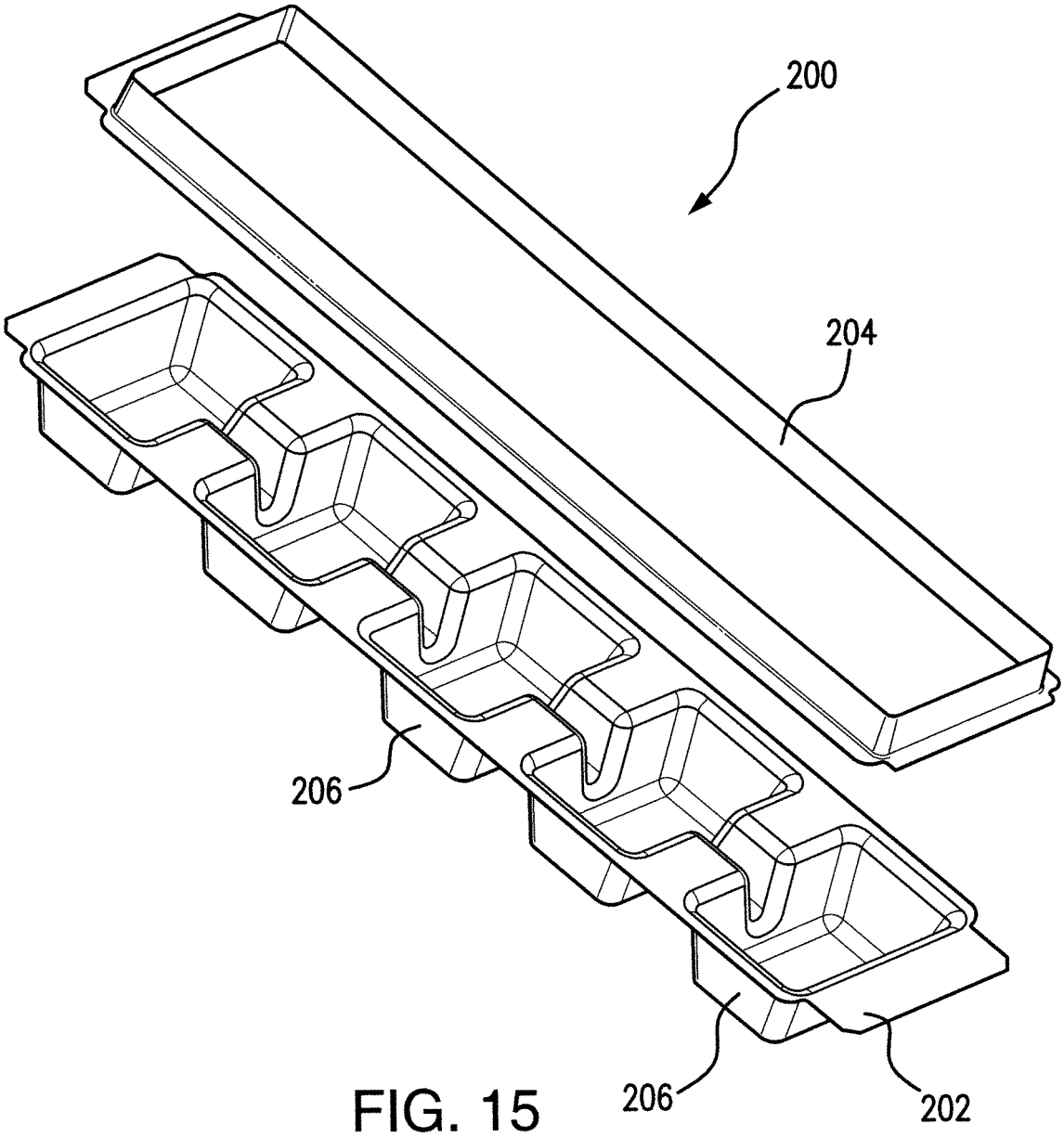
FIG. 15 is a perspective view of an ice tray according to an embodiment of the invention.

According to other embodiments of the invention, a heated circuit may be used with an improved 2-piece ice tray. As shown in FIG. 15, an ice tray 200 includes a tray or base 202 and a raised flange 204 as a tray top. The raised flange 204 acts as a perimeter barrier for the ice tray 200. The tray 202 includes a plurality of pockets or depressions 206 which are filled with water to form ice. The ice tray 200, including the depressions 206, may be fabricated by thermoforming the ice tray 200 from a thin polymer material such as described above in various embodiments. In some embodiments, the ice tray 200 may be thermoformed from a thin flexible blank of a thermoplastic material such as polycarbonate Lexan 8040. Integrated with the thermoformed ice tray 200, the tray or base 202 may also include at least one heated circuit (such as shown, for example, in FIGS. 4 and 5).

As in some embodiments, the ice tray 200 may be included in an icemaker that is configured in a door of a refrigerator. Being configured in a door means that the icemaker may have to withstand constant and/or regular movements resulting from the refrigerator door opening and closing. This can cause splashing of water out of the ice tray 200 if/when the refrigerator door is opened and closed when ice is forming. Therefore, a deeper ice tray may be desired in order to accommodate additional space for water to move to avoid this splashing. However, increasing the depths of the depressions of the ice tray poses an additional concern as the functionality of the heated circuit decreases with an increase in depth of the depressions. The raised flange 204 provides a solution for such issues.

Figure 16:
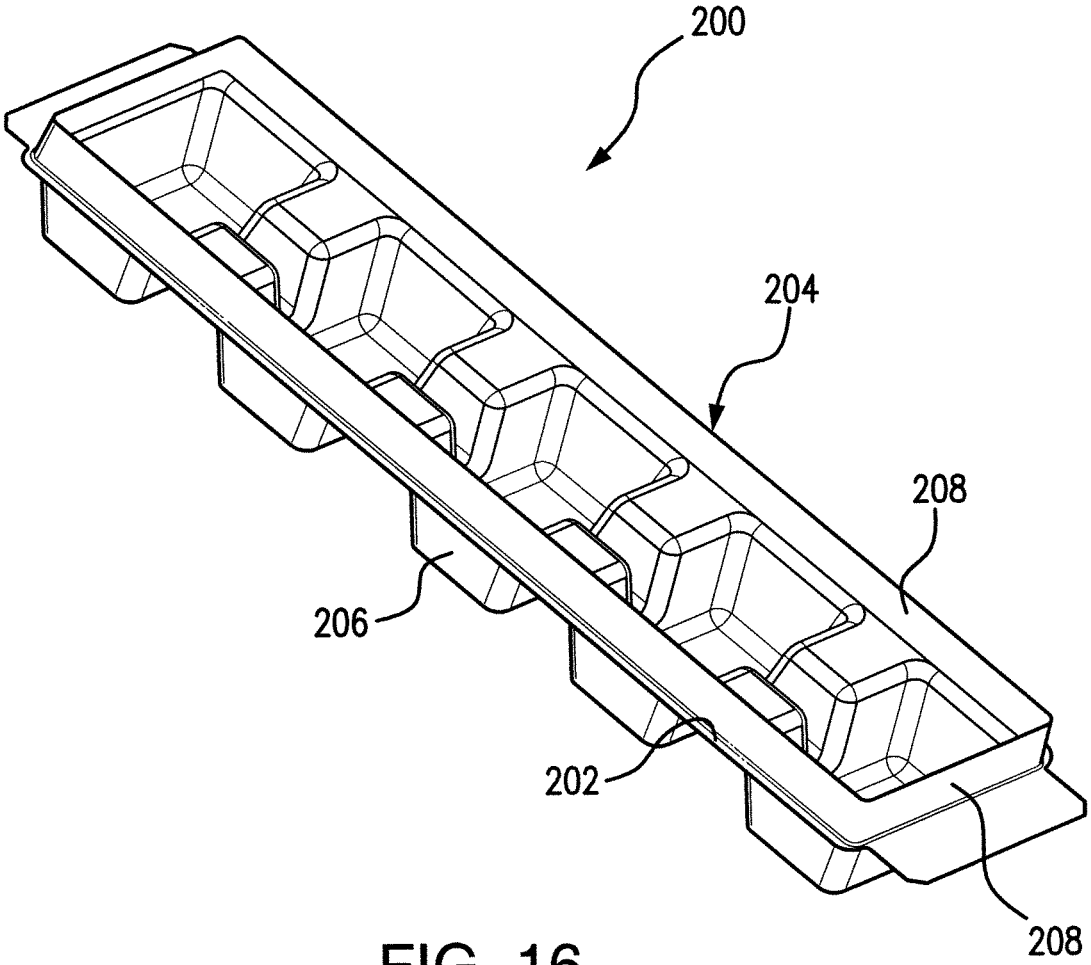
FIG. 16 is another perspective view of the ice tray according to the embodiment of FIG. 15.

As shown in FIG. 16, the raised flange 204 is positioned on top of the tray 202. The raised flange 204 is of like size and shape of the tray 202 and may be configured so that the raised flange 204 forms a raised perimeter or perimeter barrier around the tray 202. The raised flange 204 includes a hollow perimeter of raised edges or walls 208. The walls 208 may be of any number of walls, shape or size to accommodate the number of walls, shape and size of the tray 202. In some embodiments of the invention, the heated circuit of the tray 202 may extend heated coverage to the raised flange 204 to join the tray 202 and the raised flange 204 together. In other embodiments of the invention, heat staking or hot plate welding may be used to join the tray and the raised flange together around their perimeters.

This addition of the raised flange 204 to the ice tray 200 allows the depressions 206 of the ice tray 200 to remain at a desirable size and depth to where the functionality of the heated circuit for dislodging ice cubes is not compromised.

The walls 208 adjust for the shallower depth of the depressions 206 by providing a raised splash barrier so that excess water is not spilled out of the ice tray 200 when the refrigerator door is opened and closed.

Figure 17:
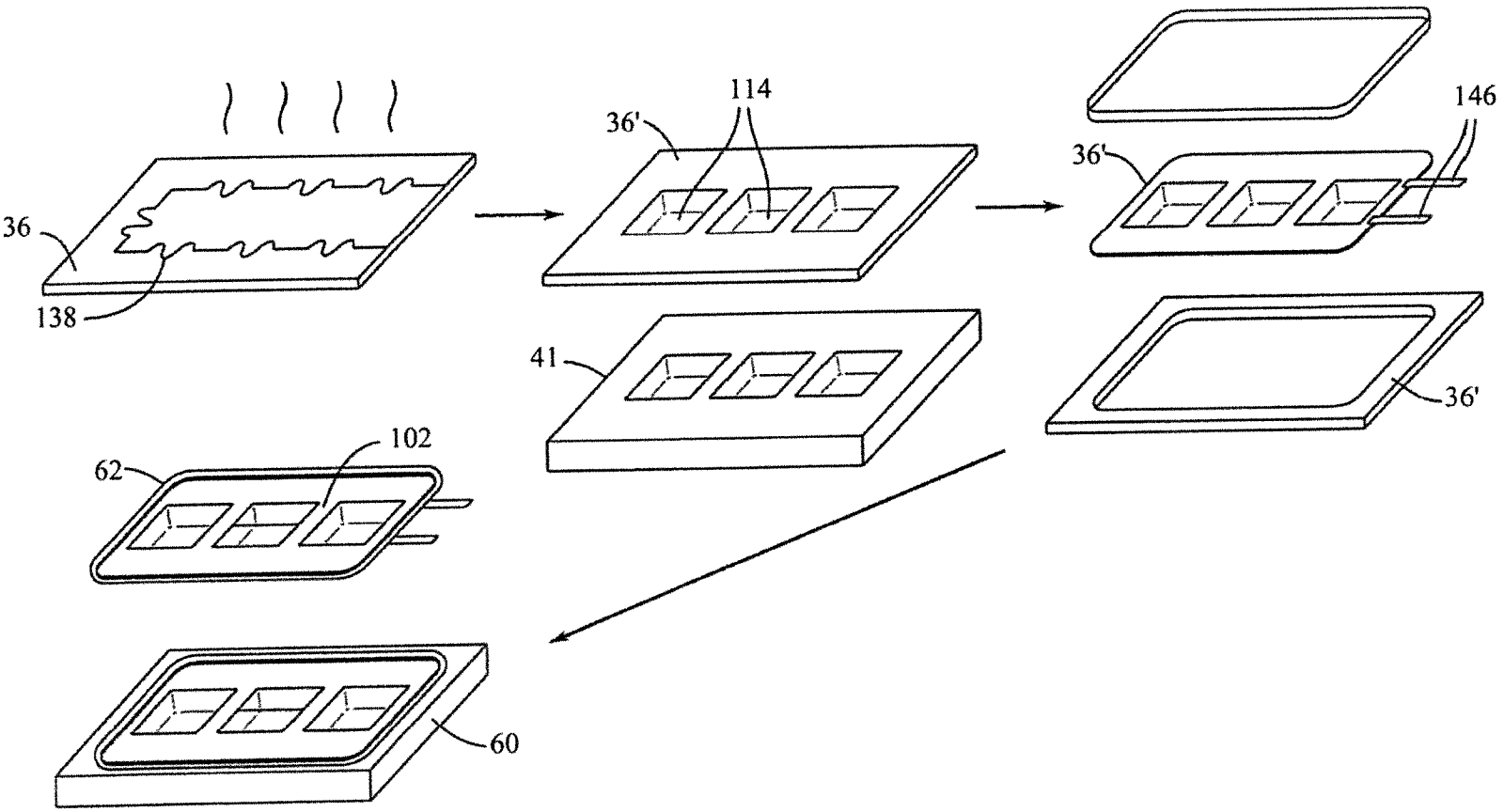
FIG. 17 is a perspective view of an ice tray according to one embodiment of the invention.

FIG. 17 shows a thermoforming process for ice trays for various embodiments of the invention. After thermoforming a blank sheet 36, the blank 36 is trimmed, for example, by a die cutter to a desired outside dimension to form an ice tray. A thermoformed ice tray may optionally be placed in an injection molding mold 60 (only one half shown for clarity) to insert-mold rim 62 over the cut edge of the form blank 36 after the die cut trimming to provide improved finish and resistance to tearing as well as better control of flexure.

An upper surface of the blank 36 may be printed with a conductor pattern 138 in the planar state to facilitate the printing process, for example, using silkscreen or the like. The conductor pattern 138 may be from a conductive polymer-based thick film ink, for example, using a silver conductor within a polymer carrier that can be stretched in postprocessing. A suitable ink is available from the DuPont company under the tradename DuPont 5025, although other inks may be used. The conductor pattern 138 will normally be printed on the bottom side of the tray (the surface opposite the water) to prevent direct electrical contact between that pattern and water in the ice tray.

Once the ink has cured, the blank 36 may be thermoformed by heating it to a pliable state and forming the pockets 114 in the blank 36 to produce a form blank 36'. The pockets 114 may be formed using a mold 41 (having recesses defining the exterior of the pockets) and drawing the blank 36 into the mold recesses using a vacuum (air pressure) and/or physical plugs (not shown) mating with the recesses according to well-known thermoforming techniques.

Problems that may occur with using a heated circuit to dislodge ice cubes from an icemaker tray include uneven distribution of heat with certain depths and shapes of depressions to create the ice cubes. Therefore, some embodiments of the invention include icemakers without added heat circuits.

Figure 18:
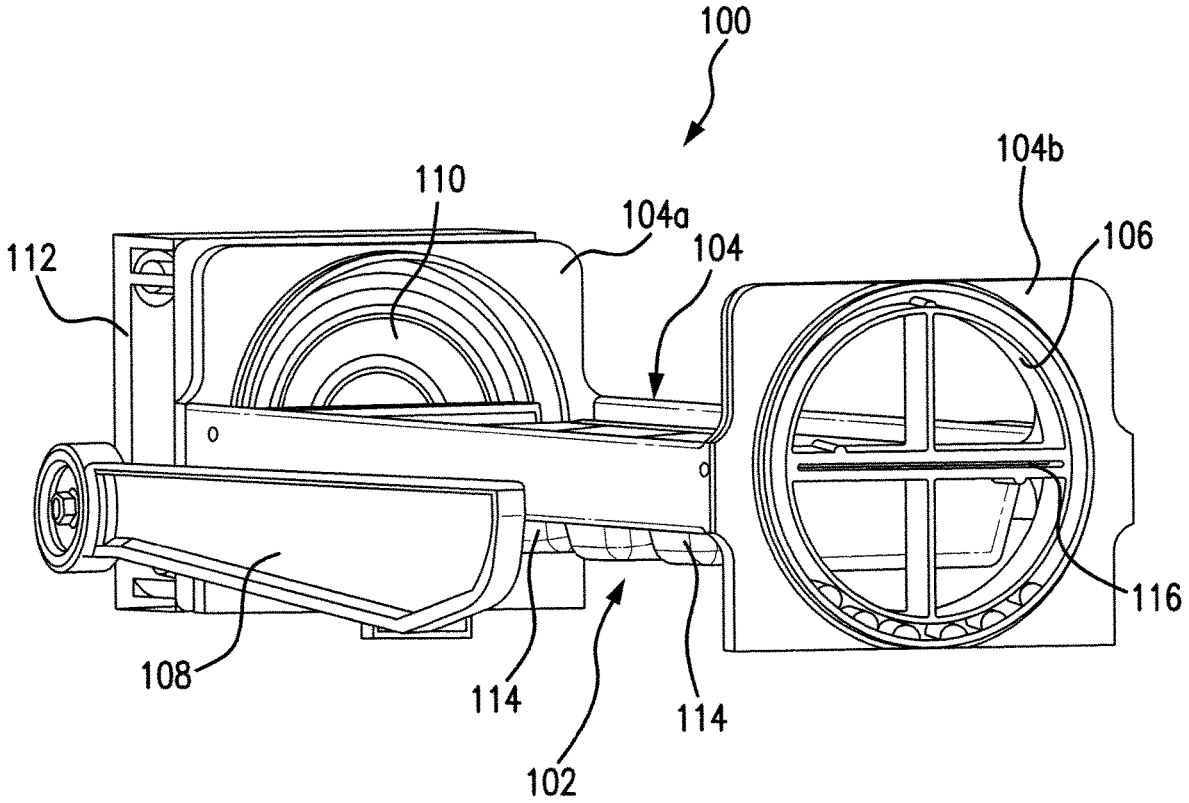
FIG. 18 is a perspective view of an icemaker according to one embodiment of the invention.

FIG. 18 shows an embodiment of the invention including an icemaker 100 with an ice tray 102 positioned adjacent to a drive arm 108 to release ice cubes without the need of a heater element. The drive arm 108 connects to a rotatable drive 110 connected to a frame 104 of the icemaker 100. The rotatable drive 110 is present at a proximal end 104*a* of the frame 104 which connects to an edge of the ice tray 102. The rotatable drive 110 may be in the form of a cam insert being a generally circular disk radially symmetric about an axis. An opposite, distal end 104*b* of the frame 104 houses an insert 106 to aid in rotating the ice try 102. The insert 106 is housed in an opening 118 (shown in FIG. 20) of the distal end 104*b* of the frame 104 of the icemaker 100. The insert 106 includes a slot 116 into which an end of the ice tray 102 may be inserted. The rotatable drive 110 can communicate with a drive housing or motor 112 at the proximal end 104*a* of the frame 104 which may contain an electric motor for rotating the ice tray 102. The motor can be of various types of electric motors such as a DC permanent magnet motor, a stepper motor, or other electrical motor discussed throughout embodiments of this invention and well known in the art. In other embodiments of the invention the motor may also be battery operated or solar powered. The drive arm may be a drive arm according to methods well known in the art, for example, as described in U.S Patent Publication No. 2012/0186288, entitled "Ice-Harvest Drive Mechanism with Dual Position Bail Arm," hereby incorporated by reference.

As shown in FIG. 18, the ice tray 102 is in an upright position allowing the ice tray 102 to be filled with water to form ice. Water fills in a plurality of pockets 114 in the ice tray 102. Once ice is made, the ice tray 102 is rotated to an inverted position (shown in FIG. 22). The inverted position causes the ice tray 102 to be rotated approximately 180 degrees, or any other suitable degree of rotation to cause the formed ice cubes to release from the ice tray 102. In some embodiments, the tray may be rotated a full 360 degrees, particularly to return the ice tray 102 to the upright position after the ice cubes are released. The ice tray 102 rotates about a rotational axis of the rotatable drive 110 so that the ice tray 102 is inverted to discharge ice cubes into a lower collection bin (such as shown in FIG. 1). The rotatable drive 110 may rotate either clockwise or counterclockwise depending on the overall layout of the icemaker 100.

Figure 19:
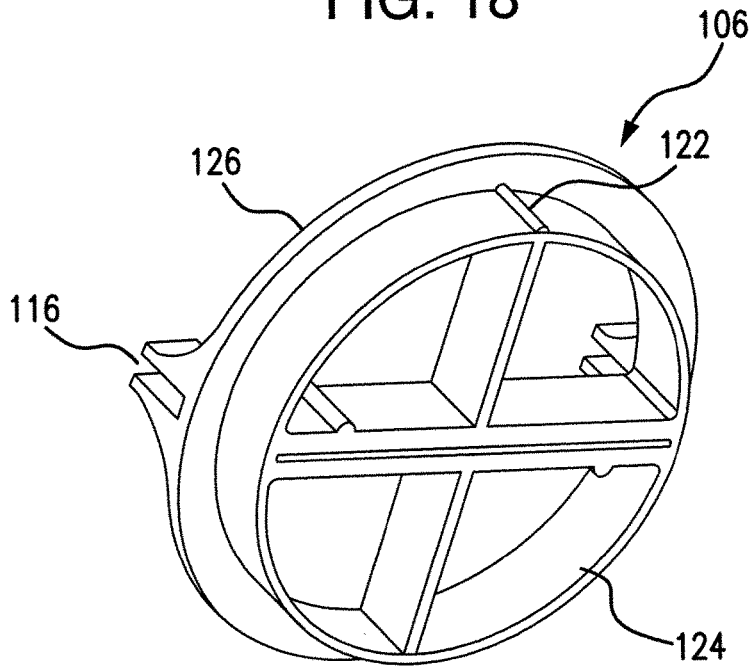
FIG. 19 is a perspective view of an insert of the icemaker according to the embodiment of FIG. 18.

Now referring to FIG. 19, the insert 106 includes an inner edge 124 and an outer edge 126. The inner edge 124 forms an inner circumference of the insert 106 and is housed within a distal circular opening 118 of the frame 104 (shown in FIG. 20). The inner edge 124 may be in the form of a flange to sit in the opening 118. The outer edge 126 forms an outer circumference of the insert 106 and is wider in diameter than the inner edge 124. The outer edge 126 is wider than the opening 118 so that the insert 106 may be held in place to avoid the insert 106 falling through the opening 118. The outer edge 126 also includes the slot 116 to accept the ice tray 102. The slot 116 may extend an entire length of an edge of the ice tray 102 by extending at least a portion of the diameter of the insert 106 or the slot 116 may accept the ice tray 102 at one or more points along the diameter of the outer edge 126. In some embodiments of the invention the inner edge 124 includes a projection 122. The projection 122 may be of a variety of shapes and sizes and protrudes out from the inner edge 124 of the insert 106. In one embodiment, as shown in FIG. 19, the projection 122 may be a semi-cylinder extending longitudinally on a point of the inner edge 124.

Figure 20:
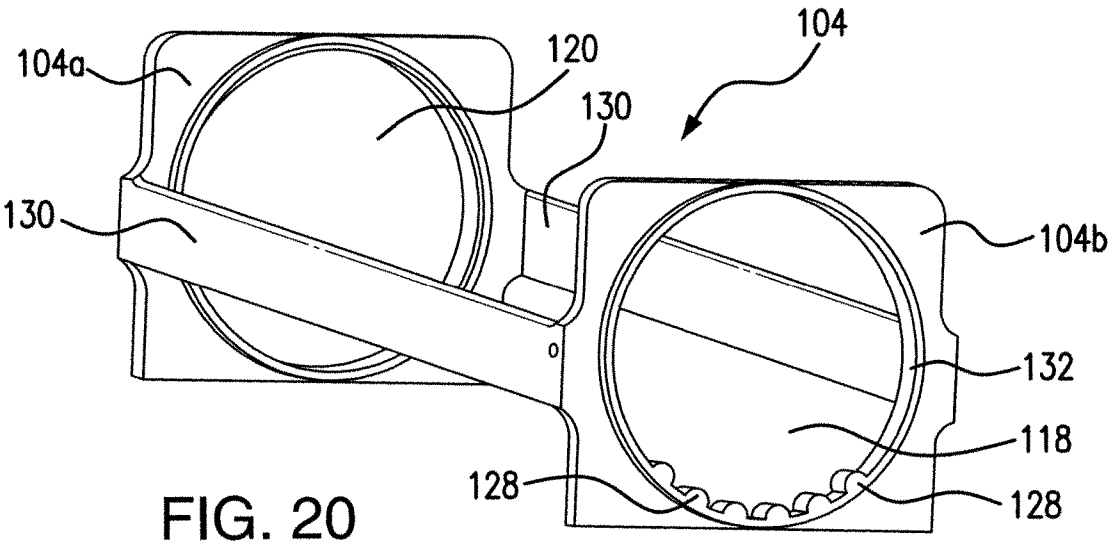
FIG. 20 is a perspective view of a frame of the icemaker according to the embodiment of FIG. 18.

FIG. 20 shows an isolated view of the frame 104 of the icemaker 100 of FIG. 18. As mentioned above, the distal opening 118 on the distal end 104*b* of the frame 104 may house the insert 106. A proximal opening 120 may also be included on the proximal end 104*a* of the frame 104. The proximal opening 120 may house the rotatable drive 110. As shown, the frame 104 also includes two complimentary side pieces 130 to connect the proximal and distal ends 104*a*, 104*b* of the frame 104. Collectively, the side pieces 130, proximal end 104*a* and distal end 104*b* form the frame 104 which fits and surrounds a perimeter of the ice tray 102. All four aforementioned pieces form the sides of the frame 104. It is to be understood that the frame 104 may be modified to fit a variety of shapes and sizes of varying ice tray configurations and to accommodate varying embodiments of the invention as discussed herein.

Figure 21:
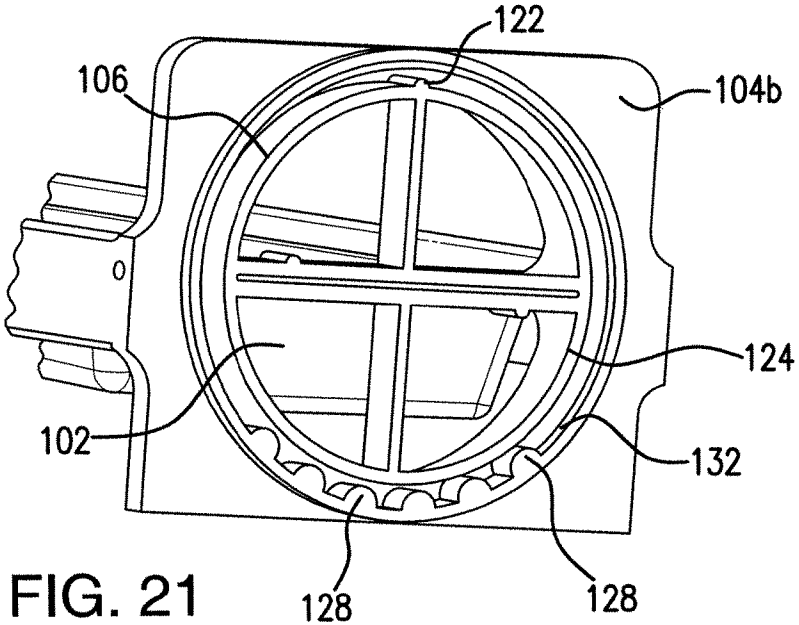
FIG. 21 is a partial perspective view of the icemaker according to the embodiment of FIG. 18.

The circular distal opening 118 further includes a plurality of protrusions 128. The plurality of protrusions 128 may be of a variety of shapes and sizes and protrude out from an inner perimeter 132 of the distal opening 118. In one embodiment, as shown in FIG. 20, the plurality of protrusions 128 are of a semi-cylinder shape extending longitudinally on points of the inner perimeter 132. In one embodiment of the invention, the protrusions 128 may be arranged in a lower portion of the opening 118 and may occur in only one quadrant of the opening 118. As shown in FIG. 21, the plurality of protrusions 128 extend from the inner perimeter 132 of the distal opening 118, and protrude into the distal opening 118, without interfering with the inner edge 124 of the insert 106 when the insert 106 is inserted into the distal opening 118.

Figure 22:
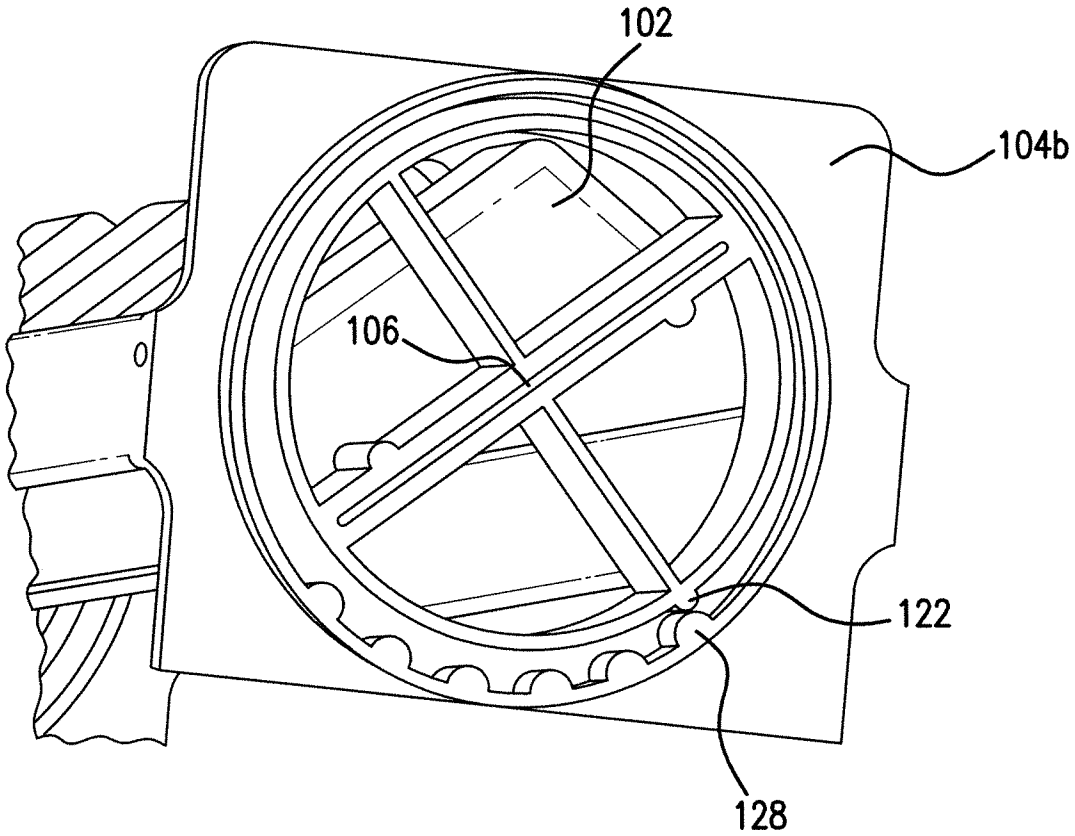
FIG. 22 is another partial perspective view of the icemaker according to the embodiment of FIG. 18.

When the ice tray 102 is rotated to an inverted position, as shown in FIG. 22, the projection 122 of the insert 106 will eventually rotate within the distal opening 118 to meet the plurality of protrusions 128. The projection 122 will then butt up against each protrusion of the plurality of protrusions 128 as the insert 106 continues to rotate and the ice tray 102 continues to invert. The contact made between the projection 122 and the protrusions 128 causes a vibration as the insert projection 122 hits each opening protrusion 128. This contact in turn vibrates the ice tray 102 as it inverts. The vibration aids to shake and dislodge ice cubes out of the tray 102 and into a collection bin. The vibration caused by the interaction of the projection 122 and protrusions 128 allows the icemaker 100 to dislodge ice cubes without the need to add a heated circuit integrated into the icemaker 100. The location and quantity of protrusions 128 may be modified in other embodiments to achieve the desired amount of vibration required to dislodge ice cubes from trays of various sizes and shapes.

The low ejection force for ejecting ice as is required by the icemaker throughout embodiments of the invention, allows the use of low-power versions of such motors, for example, consuming less than 10 watts. The use of a stepper motor allows simplified control of the ice tray position through step counting and/or velocity through step rate control, for example, by a microcontroller using well-known techniques, possibly eliminating the need for limit switches or other sensors for monitoring ice tray positions.

Figure 25:
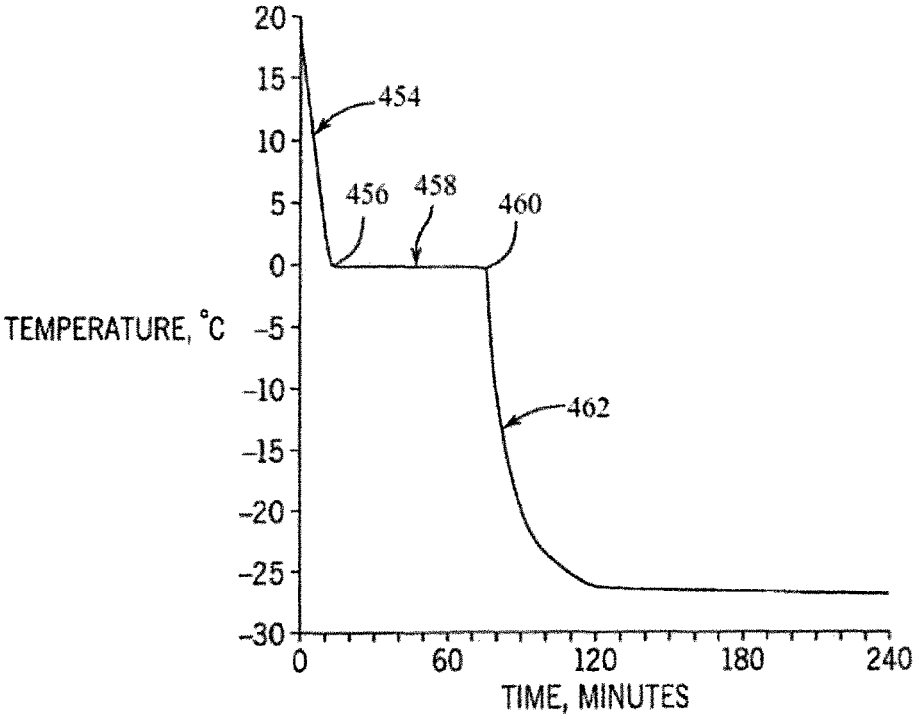
FIG. 25 shows a graph of temperature versus time as is known in the art.

In general, during standard freezing of ice cubes without simultaneous heating to improve ice clarity, temperature of the water within the ice mold or ice tray will drop rapidly until the phase change temperature of water and ice is reached. This is shown in FIG. 25 as indicated by initial cooling section 454 and phase change initiation point 456. Temperature of the water stabilizes at 0° C. as indicated by phase change section 458 until the ice is fully frozen at full ice point 460. The ice may then continue to cool as indicated by cooling ice section 462 to asymptotically reach the temperature of the freezer at about −25° C.

Figure 26:
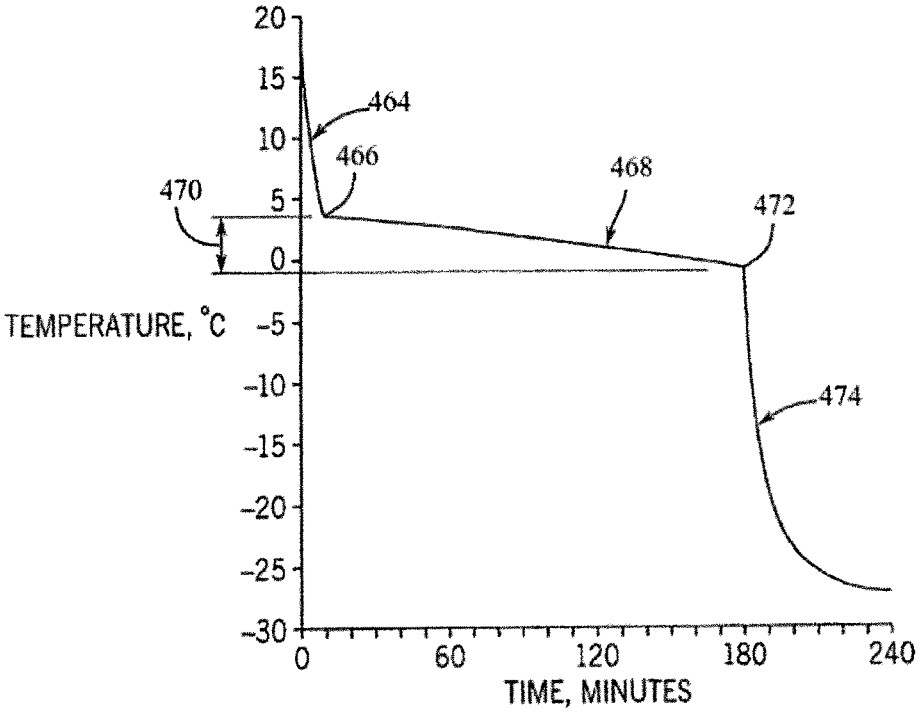
FIG. 26 shows a graph of temperature versus time according to one embodiment of the invention.

In comparison, in embodiments of the present invention, water in an ice tray may cool rapidly as indicated by section 464 in FIG. 26. Section 464 continues until a predetermined temperature, for example, 3° C., is reached as determined by the temperature sensing described in the embodiments above, or a comparable technique. At this point, the heater elements are activated, represented by heat-on point 466. The heater elements are maintained during a heat application section 468 at a low level to prolong the time with which the water in the ice mold is maintained within a freezing band 470, for example, +3° C. to 0° C. The heater elements may be activated at an average power of 0.5 W per cube cavity, being less than the power used to release the ice during the ejection cycle. The amount of power may be set to prolong the freezing time (the time within the band 470 to an excess of 160 minutes).

This slow freezing process promotes the development of clear ice. Heater elements may be activated prior to a full freezing of the ice cubes (or before the time of full ice point 472). A slight agitation of the ice tray may be made described with respect to tray flexing (such as at process block 352 in FIG. 12). During the cooling ice section 474, the ice cools further to approach the temperature of the freezer.

Figure 27:
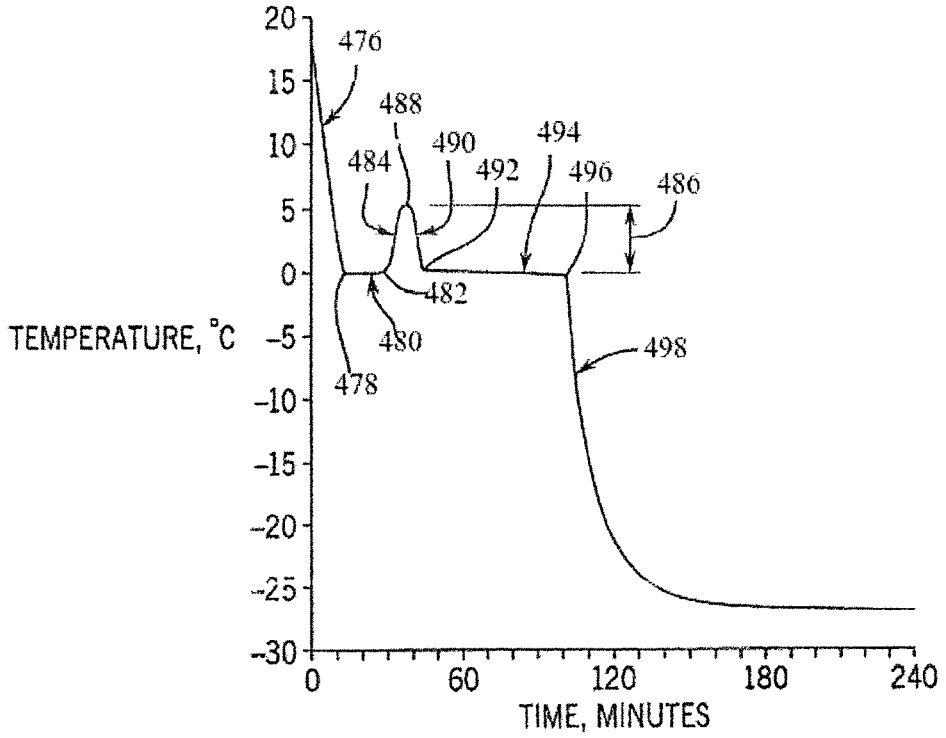
FIG. 27 shows a graph of temperature versus time according to one embodiment of the invention.

Additionally, in embodiments of the invention, water in an ice tray may cool rapidly as indicated by section 476 in FIG. 27. Similar to the unheated example shown in FIG. 25, here the water cools until a phase change initiation point 478 at about 0° C. After a short period of time, shown as about 15 minutes in FIG. 27 as an initial phase change section 480, heater elements are activated, represented at heat-on point 482. Such examples can provide more heat than described in FIG. 26. Such examples can also increase temperature beyond that in the phase change section 480 during a heating section 484 within a heating band 486, for example, +5° C. to 0° C. The heating stops after a short period of time at heat-off point 488, providing a pulse-type high-intensity heating. This rapid and slight heating may facilitate release of a top crust of ice and allow trapped gas bubbles to escape to promote clear ice, which may further be accompanied by a slight agitation of an ice tray. A second rapid cooling period at section 490 follows the heat-off point 488 and a second phase change initiation point 492 starts a second temperature-stabilized period at about 0° C. at phase change section 494 until reaching a full ice point 496. This is followed by continued cooling of ice as the ice approaches the temperature of the freezer at ice cooling section 498.

The approaches of FIGS. 26 and 27 can also be combined with each other. It is further understood that heating can continue longer, including heating for at least some time after the fully frozen point, if desired.

Figure 28:
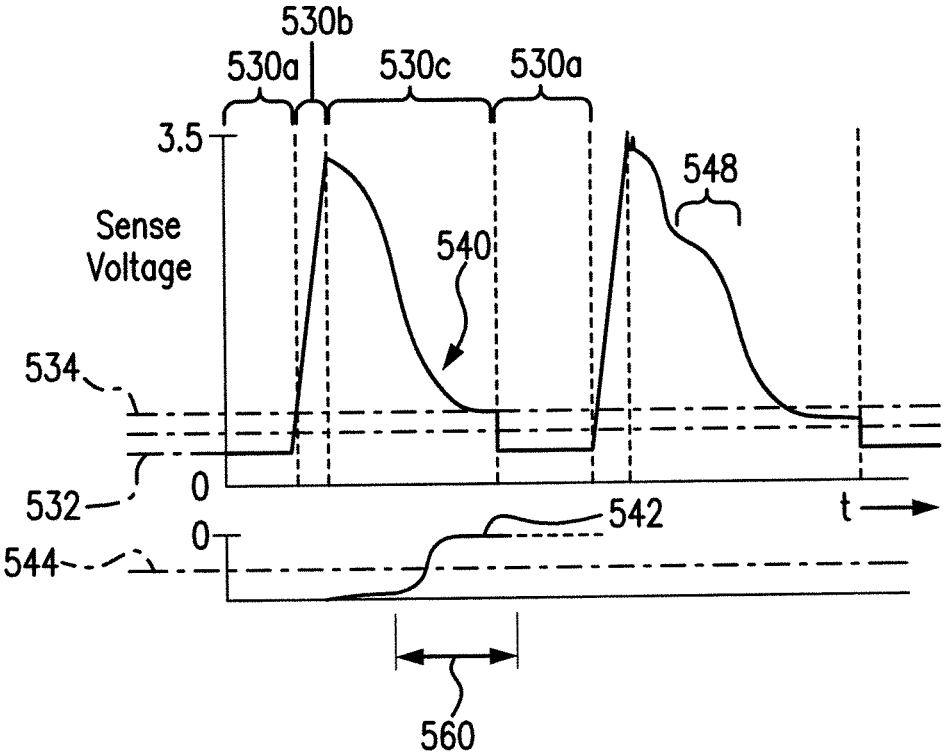
FIG. 28 shows a graph of sense voltage according to an embodiment of the invention.

According to embodiments of the invention, when the pockets of the ice tray are empty there will be a relatively low sense voltage such as at time 530*a* in FIG. 28. The low sense voltage may be compared against a higher threshold voltage having a level 534 to deduce that the trays are empty during times 530*a*. During subsequent times 530*b*, water may fill the pockets and that amount of water may be monitored by measuring the sense voltage which is increasingly affected by liquid water to provide a signal level of 536 when the trays are filled. The signal level and knowledge of the state of the ice tray allows control of the filling to a high degree of accuracy.

During a cool down time 530*c*, the water begins to freeze decreasing the sense voltage. A complete freezing of the ice in the pockets can be detected by noting the slight knee 540 in the voltage as the phase change of water to ice is completed. This knee 540 may be detected, for example, by monitoring the rate of change or derivative of the sense voltage shown by derivative signal 542 and comparing that against a derivative threshold 544. Adopting this sensitivity to rate of change rather than absolute level permits a measurement of completion of ice formation.

In embodiments of the invention, detection of ice completion can include monitoring sense voltage after the sense voltage exceeds a voltage level of approximately one volt and then looking for a differential signal of less than 25 millivolts per minute. The differential signal 542 shown in FIG. 28 is thus constrained to a window 560 minimum sense voltage threshold level before evaluating the derivative (for example after one volt). This avoids other possible derivative fluctuations 548 which can be caused, for example, by defrosting activity or the like. This also avoids the initial low slope of sense voltage immediately after filling an ice tray when water is cooling but phase change has not yet occurred.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An icemaker with an ice tray having a plurality of pockets for molding water into ice cubes, the icemaker comprising:

a first electrode positioned adjacent to at least one pocket of the plurality of pockets;

a second electrode positioned adjacent to at least one pocket of the plurality of pockets, wherein the first and second electrode are configured to detect a capacitance of water;

a controller that communicates with the first and second electrodes to detect a phase change of the water to ice in the plurality of pockets;

a heater adapted to activate and deactivate based on the phase change of the water to ice; and an ejector to eject ice from the plurality of pockets after water in the pockets freezes into ice cubes, wherein the ejector activates and deactivates the heater, wherein the ejector comprises a frame to hold the ice tray, the frame having a circular opening, wherein the circular opening includes a plurality of protrusions along an inner perimeter of the circular opening, and an insert positioned in the circular opening adapted to rotate inside the circular opening of the frame.

2. The icemaker of claim 1 wherein the controller communicates with the first and second electrodes in a first state to allow filling of the plurality of pockets of the ice tray with water, and a second state, after completion of the first state, wherein the water changes to ice.

3. The icemaker of claim 1 wherein the heater comprises a screen-printed circuit integrated into a surface of the ice tray.

4. The icemaker of claim 3 wherein the screen-printed circuit further comprises a secondary circuit adapted to sense contents and a phase of the contents in the ice cube tray.

5. The icemaker of claim 4 wherein the secondary circuit comprises a plurality of sensing elements to control a water level in the plurality of pockets.

6. The icemaker of claim 5 wherein the sensing elements comprise one or more capacitors to generate capacitive signals.

7. The icemaker of claim 5 wherein the sensing elements comprise one or more transmitters to generate radiofrequency signals.

8. The icemaker of claim 1 wherein the ice tray comprises a raised flange adapted to fit over a perimeter of the ice tray.

9. The icemaker of claim 8 wherein the raised flange comprises a wall wherein the wall extends around a perimeter of the raised flange.

10. The icemaker of claim 1 wherein the ice tray is thermoformed from a planar sheet of thermoplastic.

11. The icemaker of claim 10 wherein the planar sheet of thermoplastic comprises a thickness of less than 0.020 inches.

* * * * *